US009508276B2

(12) United States Patent
Hirakata et al.

(10) Patent No.: US 9,508,276 B2
(45) Date of Patent: Nov. 29, 2016

(54) METHOD OF DRIVING DISPLAY DEVICE INCLUDING COMPARATOR CIRCUIT, AND DISPLAY DEVICE INCLUDING COMPARATOR CIRCUIT

(71) Applicant: Semiconductor Energy Laboratory Co., Ltd., Atsugi-shi, Kanagawa-ken (JP)

(72) Inventors: Yoshiharu Hirakata, Ebina (JP); Shunpei Yamazaki, Setagaya (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 67 days.

(21) Appl. No.: 13/920,433

(22) Filed: Jun. 18, 2013

(65) Prior Publication Data

US 2014/0002425 A1 Jan. 2, 2014

(30) Foreign Application Priority Data

Jun. 29, 2012 (JP) ..... 2012-147337

(51) Int. Cl.
*G09G 3/36* (2006.01)
*G09G 3/20* (2006.01)

(52) U.S. Cl.
CPC ..... *G09G 3/20* (2013.01); *G09G 3/3648* (2013.01); *G09G 2310/0256* (2013.01); *G09G 2310/04* (2013.01); *G09G 2330/02* (2013.01); *G09G 2360/12* (2013.01); *G09G 2360/18* (2013.01)

(58) Field of Classification Search
CPC ..... G09G 3/36–3/3696; G09G 5/022; G09G 2300/0809–2300/0895; G09G 2310/00–2310/0205; G09G 2310/0243–2310/0297; G09G 2340/16
USPC ..... 345/87–104, 209–213, 690–699
See application file for complete search history.

(56) References Cited

U.S. PATENT DOCUMENTS 4,128,901 A 12/1978 Miller
5,475,398 A 12/1995 Yamazaki et al.
(Continued)

FOREIGN PATENT DOCUMENTS

EP 0750288 A 12/1996
EP 1737044 A 12/2006
(Continued)

OTHER PUBLICATIONS

Tsuda.K et al., "Ultra Low Power Consumption Technologies for Mobile TFT-LCDs ,", IDW '02 : Proceedings of the 9th International Display Workshops, Dec. 4, 2002, pp. 295-298.
(Continued)

*Primary Examiner* — Sanghyuk Park
(74) *Attorney, Agent, or Firm* — Robinson Intellectual Property Law Office; Eric J. Robinson

(57) ABSTRACT

In a second memory device, (n+1)th frame image data in an mth row (m is a natural number) is stored. In a comparator circuit, the nth frame image data in the mth row and the (n+1)th frame image data in the mth row are compared and determination data is output to a writing control circuit. In the writing control circuit, writing using the (n+1)th frame image data to a pixel in the mth row is not performed when the determination data indicates sameness, or the writing using the (n+1)th frame image data to the pixel in the mth row is performed when the determination data indicates difference. When performed in two or more successive frame periods, the writing using the (n+1)th frame image data is performed while video voltages having the same polarity are applied.

18 Claims, 11 Drawing Sheets

(56) References Cited

U.S. PATENT DOCUMENTS 5,717,421 A 2/1998 Katakura et al.
5,731,856 A 3/1998 Kim et al.
5,744,864 A 4/1998 Cillessen et al.
5,754,154 A 5/1998 Katakura et al.
5,844,535 A 12/1998 Itoh et al.
5,917,471 A 6/1999 Choi
5,982,471 A 11/1999 Hirakata et al.
6,169,532 B1 1/2001 Sumi et al.
6,278,428 B1 8/2001 Smith et al.
6,294,274 B1 9/2001 Kawazoe et al.
6,317,109 B1 11/2001 Lee
6,452,579 B1 9/2002 Itoh et al.
6,563,174 B2 5/2003 Kawasaki et al.
6,683,666 B1 1/2004 Jang et al.
6,727,522 B1 4/2004 Kawasaki et al.
6,937,224 B1 8/2005 Miyachi
7,002,541 B2 2/2006 Yanagi et al.
7,049,190 B2 5/2006 Takeda et al.
7,061,014 B2 6/2006 Hosono et al.
7,064,346 B2 6/2006 Kawasaki et al.
7,105,868 B2 9/2006 Nause et al.
7,119,782 B2 10/2006 Sunohara et al.
7,211,825 B2 5/2007 Shih et al
7,224,339 B2 5/2007 Koyama et al.
7,282,782 B2 10/2007 Hoffman et al.
7,286,108 B2 10/2007 Tsuda et al.
7,297,977 B2 11/2007 Hoffman et al.
7,321,353 B2 1/2008 Tsuda et al.
7,323,356 B2 1/2008 Hosono et al.
7,385,224 B2 6/2008 Ishii et al.
7,402,506 B2 7/2008 Levy et al.
7,411,209 B2 8/2008 Endo et al.
7,453,065 B2 11/2008 Saito et al.
7,453,087 B2 11/2008 Iwasaki
7,462,862 B2 12/2008 Hoffman et al.
7,468,304 B2 12/2008 Kaji et al.
7,501,293 B2 3/2009 Ito et al.
7,576,829 B2 8/2009 Kikuchi et al.
7,674,650 B2 3/2010 Akimoto et al.
7,732,819 B2 6/2010 Akimoto et al.
7,791,072 B2 9/2010 Kumomi et al.
7,791,074 B2 9/2010 Iwasaki
8,243,055 B2 8/2012 Abe
2001/0024187 A1 9/2001 Sato et al.
2001/0046027 A1 11/2001 Tai et al.
2002/0056838 A1 5/2002 Ogawa
2002/0060660 A1 5/2002 Yamasaki
2002/0075205 A1 6/2002 Kimura et al.
2002/0093473 A1 7/2002 Tanaka et al.
2002/0132454 A1 9/2002 Ohtsu et al.
2002/0140685 A1 10/2002 Yamamoto et al.
2003/0058543 A1 3/2003 Sheedy et al.
2003/0063078 A1 4/2003 Hanari et al.
2003/0090481 A1 5/2003 Kimura
2003/0098860 A1 5/2003 Nakamura et al.
2003/0189401 A1 10/2003 Kido et al.
2003/0218222 A1 11/2003 Wager et al.
2004/0008171 A1 1/2004 Kimura et al.
2004/0038446 A1 2/2004 Takeda et al.
2004/0127038 A1 7/2004 Carcia et al.
2004/0169625 A1 9/2004 Park et al.
2004/0179002 A1* 9/2004 Park et al. ..... 345/204
2005/0017302 A1 1/2005 Hoffman
2005/0017928 A1 1/2005 Osame et al.
2005/0094067 A1 5/2005 Sakamoto et al.
2005/0116914 A1 6/2005 Nagao et al.
2005/0140632 A1 6/2005 Tsuda et al.
2005/0140635 A1* 6/2005 Kwon ..... G09G 3/3611 345/98
2005/0199959 A1 9/2005 Chiang et al.
2005/0237294 A1 10/2005 Miyachi
2005/0253829 A1 11/2005 Mamba et al.
2005/0270452 A1 12/2005 Ahn et al.
2006/0035452 A1 2/2006 Carcia et al.
2006/0043377 A1 3/2006 Hoffman et al.
2006/0044240 A1 3/2006 Takizawa et al.
2006/0091793 A1 5/2006 Baude et al.
2006/0108529 A1 5/2006 Saito et al.
2006/0108636 A1 5/2006 Sano et al.
2006/0110867 A1 5/2006 Yabuta et al.
2006/0113536 A1 6/2006 Kumomi et al.
2006/0113539 A1 6/2006 Sano et al.
2006/0113549 A1 6/2006 Den et al.
2006/0113565 A1 6/2006 Abe et al.
2006/0125755 A1 6/2006 Noguchi et al.
2006/0139528 A1 6/2006 Fujimori et al.
2006/0146005 A1 7/2006 Baba et al.
2006/0169973 A1 8/2006 Isa et al.
2006/0170111 A1 8/2006 Isa et al.
2006/0197092 A1 9/2006 Hoffman et al.
2006/0203154 A1 9/2006 Uchida
2006/0208977 A1 9/2006 Kimura
2006/0228974 A1 10/2006 Thelss et al.
2006/0231882 A1 10/2006 Kim et al.
2006/0238135 A1 10/2006 Kimura
2006/0244107 A1 11/2006 Sugihara et al.
2006/0267889 A1 11/2006 Kimura
2006/0284171 A1 12/2006 Levy et al.
2006/0284172 A1 12/2006 Ishii
2006/0291298 A1* 12/2006 Kang et al. ..... 365/189.07
2006/0292777 A1 12/2006 Dunbar
2007/0024187 A1 2/2007 Shin et al.
2007/0046191 A1 3/2007 Saito
2007/0052025 A1 3/2007 Yabuta
2007/0054507 A1 3/2007 Kaji et al.
2007/0090365 A1 4/2007 Hayashi et al.
2007/0108446 A1 5/2007 Akimoto
2007/0146592 A1 6/2007 Kimura
2007/0152217 A1 7/2007 Lai et al.
2007/0172591 A1 7/2007 Seo et al.
2007/0187678 A1 8/2007 Hirao et al.
2007/0187760 A1 8/2007 Furuta et al.
2007/0194379 A1 8/2007 Hosono et al.
2007/0252928 A1 11/2007 Ito et al.
2007/0272922 A1 11/2007 Kim et al.
2007/0273682 A1 11/2007 Yi et al.
2007/0287296 A1 12/2007 Chang
2008/0006877 A1 1/2008 Mardilovich et al.
2008/0038882 A1 2/2008 Takechi et al.
2008/0038929 A1 2/2008 Chang
2008/0050595 A1 2/2008 Nakagawara et al.
2008/0055218 A1 3/2008 Tsuda et al.
2008/0073653 A1 3/2008 Iwasaki
2008/0074592 A1 3/2008 Araki et al.
2008/0083950 A1 4/2008 Pan et al.
2008/0106191 A1 5/2008 Kawase
2008/0128689 A1 6/2008 Lee et al.
2008/0129195 A1 6/2008 Ishizaki et al.
2008/0166834 A1 7/2008 Kim et al.
2008/0170028 A1 7/2008 Yoshida
2008/0182358 A1 7/2008 Cowdery-Corvan et al.
2008/0224133 A1 9/2008 Park et al.
2008/0224980 A1* 9/2008 Senda ..... G09G 3/3648 345/96
2008/0254569 A1 10/2008 Hoffman et al.
2008/0258139 A1 10/2008 Ito et al.
2008/0258140 A1 10/2008 Lee et al.
2008/0258141 A1 10/2008 Park et al.
2008/0258143 A1 10/2008 Kim et al.
2008/0284929 A1 11/2008 Kimura
2008/0284970 A1 11/2008 Ishitani
2008/0296568 A1 12/2008 Ryu et al.
2008/0308797 A1 12/2008 Akimoto et al.
2009/0002597 A1 1/2009 Watanabe
2009/0006915 A1 1/2009 Gomez et al.
2009/0068773 A1 3/2009 Lai et al.
2009/0073325 A1 3/2009 Kuwabara et al.
2009/0079682 A1 3/2009 Yamato et al.
2009/0114910 A1 5/2009 Chang
2009/0134399 A1 5/2009 Sakakura et al.
2009/0152506 A1 6/2009 Umeda et al.
2009/0152541 A1 6/2009 Maekawa et al.
2009/0153761 A1 6/2009 Park et al.
2009/0174835 A1 7/2009 Lee et al.

(56) References Cited

U.S. PATENT DOCUMENTS

| | | | | |
|---|---|---|---|---|
| 2009/0179832 | A1 | 7/2009 | Kohno et al. | |
| 2009/0261325 | A1 | 10/2009 | Kawamura et al. | |
| 2009/0278122 | A1 | 11/2009 | Hosono et al. | |
| 2009/0280600 | A1 | 11/2009 | Hosono et al. | |
| 2009/0289964 | A1 | 11/2009 | Miyachi | |
| 2009/0298554 | A1 | 12/2009 | Kim et al. | |
| 2009/0303170 | A1 | 12/2009 | Chung et al. | |
| 2009/0315880 | A1 | 12/2009 | Cho et al. | |
| 2010/0065844 | A1 | 3/2010 | Tokunaga | |
| 2010/0092800 | A1 | 4/2010 | Itagaki et al. | |
| 2010/0109002 | A1 | 5/2010 | Itagaki et al. | |
| 2010/0149138 | A1 | 6/2010 | Lee et al. | |
| 2010/0163863 | A1 | 7/2010 | Yaegashi | |
| 2011/0090204 | A1 | 4/2011 | Yamazaki et al. | |
| 2011/0090207 | A1* | 4/2011 | Yamazaki et al. | 345/211 |
| 2011/0102696 | A1 | 5/2011 | Yamazaki et al. | |
| 2011/0115839 | A1 | 5/2011 | Takahashi et al. | |
| 2011/0128461 | A1 | 6/2011 | Koyama et al. | |
| 2011/0134350 | A1 | 6/2011 | Yamazaki et al. | |
| 2011/0148826 | A1 | 6/2011 | Koyama et al. | |
| 2011/0157252 | A1 | 6/2011 | Yamazaki et al. | |
| 2011/0157253 | A1 | 6/2011 | Yamazaki et al. | |
| 2011/0157254 | A1 | 6/2011 | Yamazaki et al. | |
| 2011/0175895 | A1 | 7/2011 | Hayakawa et al. | |
| 2011/0193852 | A1 | 8/2011 | Lee et al. | |
| 2011/0216048 | A1 | 9/2011 | Koyama et al. | |
| 2012/0032942 | A1 | 2/2012 | Toyotaka et al. | |
| 2012/0038604 | A1 | 2/2012 | Liu et al. | |
| 2012/0056861 | A1* | 3/2012 | Kurokawa et al. | 345/207 |
| 2012/0086739 | A1 | 4/2012 | Akimoto et al. | |
| 2014/0085276 | A1* | 3/2014 | Jang | G09G 3/2007 345/204 |

FOREIGN PATENT DOCUMENTS

| | | | |
|---|---|---|---|
| EP | 2226847 | A | 9/2010 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 03-114030 | A | 5/1991 |
| JP | 04-255822 | A | 9/1992 |
| JP | 05-251705 | A | 9/1993 |
| JP | 06-202077 | A | 7/1994 |
| JP | 08-264794 | A | 10/1996 |
| JP | 10-240191 | A | 9/1998 |
| JP | 11-505377 | | 5/1999 |
| JP | 2000-044236 | A | 2/2000 |
| JP | 2000-150900 | A | 5/2000 |
| JP | 2001-282206 | A | 10/2001 |
| JP | 2002-076356 | A | 3/2002 |
| JP | 2002-289859 | A | 10/2002 |
| JP | 2003-086000 | A | 3/2003 |
| JP | 2003-086808 | A | 3/2003 |
| JP | 2004-103957 | A | 4/2004 |
| JP | 2004-273614 | A | 9/2004 |
| JP | 2004-273732 | A | 9/2004 |
| JP | 2006-165528 | A | 6/2006 |
| JP | 2007-194594 | A | 8/2007 |
| WO | WO-2004/114391 | | 12/2004 |

OTHER PUBLICATIONS

Fortunato.E et al., "Wide-Bandgap High-Mobility ZNO Thin-Film Transistors Produced at Room Temperature,", Appl. Phys. Lett. (Applied Physics Letters) , Sep. 27, 2004, vol. 85, No. 13, pp. 2541-2543.

Dembo.H et al., "RFCPUS on Glass and Plastic Substrates Fabricated by TFT Transfer Technology,", IEDM 05: Technical Digest of International Electron Devices Meeting, Dec. 5, 2005, pp. 1067-1069.

Ikeda.T et al., "Full-Functional System Liquid Crystal Display Using Cg-Silicon Technology,", SID Digest '04 : SID International Symposium Digest of Technical Papers, 2004, vol. 35, pp. 860-863.

Nomura.K et al., "Room-Temperature Fabrication of Transparent Flexible Thin-Film Transistors Using Amorphous Oxide Semiconductors,", Nature, Nov. 25, 2004, vol. 432, pp. 488-492.

Park.J et al., "Improvements in the Device Characteristics of Amorphous Indium Gallium Zinc Oxide Thin-Film Transistors by Ar Plasma Treatment,", Appl. Phys. Lett. (Applied Physics Letters) , Jun. 26, 2007, vol. 90, No. 26, pp. 262106-1-262106-3.

Takahashi.M et al., "Theoretical Analysis of IGZO Transparent Amorphous Oxide Semiconductor,", IDW '08 : Proceedings of the 15th International Display Workshops, Dec. 3, 2008, pp. 1637-1640.

Hayashi.R et al., "42.1: Invited Paper: Improved Amorphous In—Ga—Zn—O TFTS,", SID Digest '08 : SID International Symposium Digest of Technical Papers, May 20, 2008, vol. 39, pp. 621-624.

Prins.M et al., "A Ferroelectric Transparent Thin-Film Transistor,", Appl. Phys. Lett. (Applied Physics Letters) , Jun. 17, 1996, vol. 68, No. 25, pp. 3650-3652.

Nakamura.M et al., "The phase relations in the In2O3—Ga2ZnO4—ZnO system at 1350° C.,", Journal of Solid State Chemistry, Aug. 1, 1991, vol. 93, No. 2, pp. 298-315.

Kimizuka.N. et al., "Syntheses and Single-Crystal Data of Homologous Compounds, In2O3(ZnO)m (m=3, 4, and 5), InGaO3(ZnO)3, and Ga2O3(Zno)m (m=7, 8, 9, and 16) in the In2O3—ZnGa2O4—ZnO System,", Journal of Solid State Chemistry, Apr. 1, 1995, vol. 116, No. 1, pp. 170-178.

Nomura.K et al., "Thin-Film Transistor Fabricated in Single-Crystalline Transparent Oxide Semiconductor,", Science, May 23, 2003, vol. 300, No. 5623, pp. 1269-1272.

Masuda.S et al., "Transparent thin film transistors using ZnO as an active channel layer and their electrical properties,", J. Appl. Phys. (Journal of Applied Physics) , Feb. 1, 2003, vol. 93, No. 3, pp. 1624-1630.

Asakuma.N. et al., "Crystallization and Reduction of Sol-Gel-Derived Zinc Oxide Films by Irradiation With Ultraviolet Lamp,", Journal of Sol-Gel Science and Technology, 2003, vol. 26, pp. 181-184.

Osada.T et al., "15.2: Development of Driver-Integrated Panel using Amorphous In—Ga—Zn—Oxide TFT,", SID Digest '09 : SID International Symposium Digest of Technical Papers, May 31, 2009, pp. 184-187.

Nomura.K et al., "Carrier transport in transparent oxide semiconductor with intrinsic structural randomness probed using single-crystalline InGaO3(ZnO)5 films,", Appl. Phys. Lett. (Applied Physics Letters) , Sep. 13, 2004, vol. 85, No. 11, pp. 1993-1995.

Li.C et al., "Modulated Structures of Homologous Compounds InMO3(ZnO)m (M=In,Ga; m=Integer) Described by Four-Dimensional Superspace Group,", Journal of Solid State Chemistry, 1998, vol. 139, pp. 347-355.

Son.K et al., "42.4L: Late-News Paper: 4 Inch QVGA AMOLED Driven by the Threshold Voltage Controlled Amorphous GIZO (Ga2O3—In2O3—ZnO) TFT,", SID Digest '08 : SID International Symposium Digest of Technical Papers, May 20, 2008, vol. 39, pp. 633-636.

Lee.J et al., "World'S Largest (15-Inch) XGA AMLCD Panel Using IGZO Oxide TFT,", SID Digest '08 : SID International Symposium Digest of Technical Papers, May 20, 2008, vol. 39, pp. 625-628.

Nowatari.H et al., "60.2: Intermediate Connector With Suppressed Voltage Loss for White Tandem OLEDS,", SID Digest '09 : SID International Symposium Digest of Technical Papers, May 31, 2009, vol. 40, pp. 899-902.

Kanno.H et al., "White Stacked Electrophosphorecent Organic Light-Emitting Devices Employing MOO3 as a Charge-Generation Layer,", Adv. Mater. (Advanced Materials), 2006, vol. 18, No. 3, pp. 339-342.

Van de Walle.C, "Hydrogen as a Cause of Doping in Zinc Oxide,", Phys. Rev. Lett. (Physical Review Letters), Jul. 31, 2000, vol. 85, No. 5, pp. 1012-1015.

(56) References Cited

OTHER PUBLICATIONS

Fung.T et al., "2-D Numerical Simulation of High Performance Amorphous In—Ga—Zn—O TFTs for Flat Panel Displays,", AM-FPD '08 Digest of Technical Papers, Jul. 2, 2008, pp. 251-252, The Japan Society of Applied Physics.
Jeong.J et al., "3.1: Distinguished Paper: 12.1-Inch WXGA AMOLED Display Driven by Indium—Gallium—Zinc Oxide TFTs Array,", SID Digest '08 : SID International Symposium Digest of Technical Papers, May 20, 2008, vol. 39, No. 1, pp. 1-4.
Park.J et al., "High performance amorphous oxide thin film transistors with self-aligned top-gate structure,", IEDM 09: Technical Digest of International Electron Devices Meeting, Dec. 7, 2009, pp. 191-194.
Kurokawa.Y et al., "UHF RFCPUS on Flexible and Glass Substrates for Secure RFID Systems,", Journal of Solid-State Circuits, 2008, vol. 43, No. 1, pp. 292-299.
Ohara.H et al., "Amorphous In—Ga—Zn—Oxide TFTs with Suppressed Variation for 4.0 inch QVGA AMOLED Display,", AM-FPD '09 Digest of Technical Papers, Jul. 1, 2009, pp. 227-230, The Japan Society of Applied Physics.
Coates.D et al., "Optical Studies of the Amorphous Liquid-Cholesteric Liquid Crystal Transition:The "Blue Phase",", Physics Letters, Sep. 10, 1973, vol. 45A, No. 2, pp. 115-116.
Cho.D et al., "21.2:Al and Sn-Doped Zinc Indium Oxide Thin Film Transistors for AMOLED Back-Plane,", SID Digest '09 : SID International Symposium Digest of Technical Papers, May 31, 2009, pp. 280-283.
Lee.M et al., "15.4:Excellent Performance of Indium—Oxide-Based Thin-Film Transistors by DC Sputtering,", SID Digest '09 : SID International Symposium Digest of Technical Papers, May 31, 2009, pp. 191-193.
Jin.D et al., "65.2:Distinguished Paper:World-Largest (6.5") Flexible Full Color Top Emission AMOLED Display on Plastic Film and its Bending Properties,", SID Digest '09 : SID International Symposium Digest of Technical Papers, May 31, 2009, pp. 983-985.
Sakata.J et al., "Development of 4.0-In. AMOLED Display With Driver Circuit Using Amorphous In—Ga—Zn—Oxide TFTS,", IDW '09 : Proceedings of the 16th International Display Workshops, 2009, pp. 689-692.
Park.J et al., "Amorphous Indium—Gallium—Zinc Oxide TFTS and Their Application for Large Size AMOLED,", AM-FPD '08 Digest of Technical Papers, Jul. 2, 2008, pp. 275-278.
Park.S et al., "Challenge to Future Displays: Transparent AM-OLED Driven by Peald Grown ZNO TFT,", IMID '07 Digest, 2007, pp. 1249-1252.
Godo.H et al., "Temperature Dependence of Characteristics and Electronic Structure for Amorpous In—Ga—Zn—Oxide TFT,", AM-FPD '09 Digest of Technical Papers, Jul. 1, 2009, pp. 41-44.
Osada.T et al., "Development of Driver-Integrated Panel Using Amorphous In—Ga—Zn—Oxide TFT,", AM-FPD '09 Digest of Technical Papers, Jul. 1, 2009, pp. 33-36.
Hirao.T et al., "Novel Top-Gate Zinc Oxide Thin-Film Transistors (ZNO TFTS) for AMLCDS,", Journal of the SID, 2007, vol. 15, No. 1, pp. 17-22.
Hosono.H, "68.3:Invited Paper:Transparent Amorphous Oxide Semiconductors for High Performance TFT,", SID Digest '07 : SID International Symposium Digest of Technical Papers, 2007, vol. 38, pp. 1830-1833.
Godo.H et al., "P-9:Numerical Analysis on Temperature Dependence of Characteristics of Amorphous In—Ga—Zn—Oxide TFT,", SID Digest '09 : SID International Symposium Digest of Technical Papers, May 31, 2008, pp. 1110-1112.
Ohara.H et al., "21.3:4.0 In. QVGA AMOLED Display Using In—Ga—Zn—Oxide TFTS With a Novel Passivation Layer,", SID Digest '09 : SID International Symposium Digest of Technical Papers, May 31, 2009, pp. 284-287.
Miyasaka.M, "Suftla Flexible Microelectronics on Their Way to Business,", SID Digest '07 : SID International Symposium Digest of Technical Papers, 2007, vol. 38, pp. 1673-1676.
Chern.H et al., "An Analytical Model for the Above-Threshold Characteristics of Polysilicon Thin-Film Transistors,", IEEE Transactions on Electron Devices, Jul. 1, 1995, vol. 42, No. 7, pp. 1240-1246.
Kikuchi.H et al., "39.1:Invited Paper:Optically Isotropic Nano-Structured Liquid Crystal Composites for Display Applications,", SID Digest '09 : SID International Symposium Digest of Technical Papers, May 31, 2009, pp. 578-581.
Asaoka.Y et al., "29.1: Polarizer-Free Reflective LCD Combined With Ultra Low-Power Driving Technology,", SID Digest '09 : SID International Symposium Digest of Technical Papers, May 31, 2009, pp. 395-398.
Lee.H et al., "Current Status of, Challenges to, and Perspective View of AM-OLED ,", IDW '06 : Proceedings of the 13th International Display Workshops, Dec. 7, 2006, pp. 663-666.
Kikuchi.H et al., "62.2:Invited Paper:Fast Electro-Optical Switching in Polymer-Stabilized Liquid Crystalline Blue Phases for Display Application,", SID Digest '07 : SID International Symposium Digest of Technical Papers, 2007, vol. 38, pp. 1737-1740.
Nakamura.M, "Synthesis of Homologous Compound with New Long-Period Structure,", NIRIM Newsletter, Mar. 1, 1995, vol. 150, pp. 1-4.
Kikuchi.H et al., "Polymer-Stabilized Liquid Crystal Blue Phases,", Nature Materials, Sep. 2, 2002, vol. 1, pp. 64-68.
Kimizuka.N. et al., "SPINEL,YBFE2O4, and YB2FE3O7 Types of Structures for Compounds in the In2O3 and Sc2O3—A2O3—BO Systems [A: Fe, Ga, or Al; B: Mg, Mn, Fe, Ni, Cu, or Zn] at Temperatures over 1000° C.,", Journal of Solid State Chemistry, 1985, vol. 60, pp. 382-384.
Kitzerow.H et al., "Observation of Blue Phases in Chiral Networks,", Liquid Crystals, 1993, vol. 14, No. 3, pp. 911-916.
Costello.M et al., "Electron Microscopy of a Cholesteric Liquid Crystal and its Blue Phase,", Phys. Rev. A (Physical Review. A), May 1, 1984, vol. 29, No. 5, pp. 2957-2959.
Meiboom.S et al., "Theory of the Blue Phase of Cholesteric Liquid Crystals,", Phys. Rev. Lett. (Physical Review Letters), May 4, 1981, vol. 46, No. 18, pp. 1216-1219.
Park.Sang-Hee et al., "42.3: Transparent ZnO Thin Film Transistor for the Application of High Aperture Ratio Bottom Emission AM-OLED Display,", SID Digest '08 : SID International Symposium Digest of Technical Papers, May 20, 2008, vol. 39, pp. 629-632.
Orita.M et al., "Mechanism of Electrical Conductivity of Transparent InGaZnO4,", Phys. Rev. B (Physical Review. B), Jan. 15, 2000, vol. 61, No. 3, pp. 1811-1816.
Nomura.K et al., "Amorphous Oxide Semiconductors for High-Performance Flexible Thin-Film Transistors,", Jpn. J. Appl. Phys. (Japanese Journal of Applied Physics) , 2006, vol. 45, No. 5B, pp. 4303-4308.
Janotti.A et al., "Native Point Defects in ZnO,", Phys. Rev. B (Physical Review. B), Oct. 4, 2007, vol. 76, No. 16, pp. 165202-1-165202-22.
Park.J et al., "Electronic Transport Properties of Amorphous Indium—Gallium—Zinc Oxide Semiconductor Upon Exposure to Water,", Appl. Phys. Lett. (Applied Physics Letters) , 2008, vol. 92, pp. 072104-1-072104-3.
Hsieh.H et al., "P-29:Modeling of Amorphous Oxide Semiconductor Thin Film Transistors and Subgap Density of States,", SID Digest '08 : SID International Symposium Digest of Technical Papers, 2008, vol. 39, pp. 1277-1280.
Janotti.A et al., "Oxygen Vacancies in ZnO,", Appl. Phys. Lett. (Applied Physics Letters) , 2005, vol. 87, pp. 122102-1-122102-3.
Oba.F et al., "Defect energetics in ZnO: A hybrid Hartree-Fock density functional study,", Phys. Rev. B (Physical Review. B), 2008, vol. 77, pp. 245202-1-245202-6.
Orita.M et al., "Amorphous transparent conductive oxide InGaO3(ZnO)m (m<4):a Zn4s conductor,", Philosophical Magazine, 2001, vol. 81, No. 5, pp. 501-515.
Hosono.H et al., "Working hypothesis to explore novel wide band gap electrically conducting amorphous oxides and examples,", J. Non-Cryst. Solids (Journal of Non-Crystalline Solids), 1996, vol. 198-200, pp. 165-169.

(56) References Cited

OTHER PUBLICATIONS

Mo.Y et al., "Amorphous Oxide TFT Backplanes for Large Size AMOLED Displays,", IDW '08 : Proceedings of the 6th International Display Workshops, Dec. 3, 2008, pp. 581-584.
Kim.S et al., "High-Performance oxide thin film transistors passivated by various gas plasmas,", 214th ECS Meeting, 2008, No. 2317, ECS.
Clark.S et al., "First Principles Methods Using CASTEP,", Zeitschrift fur Kristallographie, 2005, vol. 220, pp. 567-570.
Lany.S et al., "Dopability, Intrinsic Conductivity, and Nonstoichiometry of Transparent Conducting Oxides,", Phys. Rev. Lett. (Physical Review Letters), Jan. 26, 2007, vol. 98, pp. 045501-1-045501-4.
Park.J et al., "Dry etching of ZnO films and plasma-induced damage to optical properties,", J. Vac. Sci. Technol. B (Journal of Vacuum Science & Technology B), Mar. 1, 2003, vol. 21, No. 2, pp. 800-803.
Oh.M et al., "Improving the Gate Stability of ZNO Thin-Film Transistors With Aluminum Oxide Dielectric Layers,", J. Electrochem. Soc. (Journal of the Electrochemical Society), 2008, vol. 155, No. 12, pp. H1009-H1014.
Ueno.K et al., "Field-Effect Transistor on SrTiO3 With Sputtered Al2O3 Gate Insulator,", Appl. Phys. Lett. (Applied Physics Letters) , Sep. 1, 2003, vol. 83, No. 9, pp. 1755-1757.

* cited by examiner

METHOD OF DRIVING DISPLAY DEVICE INCLUDING COMPARATOR CIRCUIT, AND DISPLAY DEVICE INCLUDING COMPARATOR CIRCUIT

BACKGROUND OF THE INVENTION

1. Field of the Invention

The present invention relates to a method of driving a display device and to a display device.

2. Description of the Related Art

In recent years, attention has been focused on the development of low-power consumption display devices.

To reduce power consumption of display devices, reducing the number of times of rewriting a video voltage is important. For example, to reduce the number of times of rewriting a video voltage, techniques in which a break period longer than a scanning period is set as a non-scanning period every time after a video voltage is written by scanning a screen in the case of displaying a still image have been reported (e.g., see Patent Document 1 and Non-Patent Document 1).

REFERENCES

Patent Document 1: U.S. Pat. No. 7,321,353

Non-Patent Document 1: K. Tsuda et al., IDW '02, Proc., pp. 295-298

In the driving method described in Patent Document 1, power consumption can be reduced only in the case of displaying a still image in the entire screen. Lower power consumption is demanded even in the case of displaying a moving image, where screen data needs to be written by scanning the entire screen.

There is a recent trend in display devices toward more pixels and higher driving frequencies of 60 Hz, 120 Hz, and 240 Hz to display a high definition and less flickering image. This demands high-speed driving of a gate line driver circuit and a data line driver circuit, and even lower power consumption also in this case.

The mainstream of a display device structure is a structure in which inversion driving is performed at least every frame period to reduce influence of burn-in due to deterioration of a display element, such as gate line inversion driving, source line inversion driving, frame inversion driving, or dot inversion driving.

However, a problem in inversion driving is that, even if the absolute values of voltages applied to a display element are almost unchanged, the amount of video voltage change increases and accordingly power consumption increases. This problem is particularly prominent in driving with a high frequency, in which case a further reduction in power consumption is demanded.

In view of the above, an object of the present invention is to provide a display device in which power consumption can be reduced even when the driving frequency is high and a moving image is displayed, and a method of driving the display device.

SUMMARY OF THE INVENTION

One embodiment of the present invention is a method of driving a display device including a first memory device which stores one-frame image data, a second memory device which stores image data in one row, a comparator circuit which outputs determination data in which whether image data in the first memory device and image data in the second memory device are the same or different is determined, and a writing control circuit which controls output of image data to a display portion in accordance with the determination data. The method includes the following steps: storing nth frame image data (n is a natural number) in the first memory device; storing (n+1)th frame image data in an mth row (m is a natural number) in the second memory device; in the comparator circuit, comparing the nth frame image data in the mth row and the (n+1)th frame image data in the mth row and outputting the determination data to the writing control circuit; and, in the writing control circuit, not performing writing using the (n+1)th frame image data to a pixel in the mth row when the determination data indicates that the compared image data are the same, or performing the writing using the (n+1)th frame image data to the pixel in the mth row when the determination data indicates that the compared image data are different. When performed in two or more successive frame periods, the writing using the (n+1)th frame image data is performed while video voltages having the same polarity are applied.

One embodiment of the present invention is a method of driving a display device including a first memory device which stores one-frame image data, a second memory device which stores image data in one row, a comparator circuit which outputs determination data in which whether image data in the first memory device and image data in the second memory device are the same or different is determined, and a writing control circuit which controls output of image data to a display portion in accordance with the determination data. The method includes the following steps: storing nth frame image data (n is a natural number) in the first memory device; storing (n+1)th frame image data in an mth row (m is a natural number) in the second memory device; in the comparator circuit, comparing the nth frame image data in the mth row and the (n+1)th frame image data in the mth row and outputting the determination data to the writing control circuit; and, in the writing control circuit, not selecting a gate line in the mth row in the display portion when the determination data indicates that the compared image data are the same, or selecting the gate line in the mth row in the display portion and outputting the (n+1)th frame image data in the mth row to a data line of each column when the determination data indicates that the compared image data are different. When performed in two or more successive frame periods, writing using the (n+1)th frame image data is performed while video voltages having the same polarity are applied.

One embodiment of the present invention is a display device including a first memory device which stores one-frame image data, a second memory device which stores image data in one row, a comparator circuit which compares nth frame image data (n is a natural number) in an mth row (m is a natural number) in the first memory device and (n+1)th frame image data in the mth row in the second memory device and outputs determination data in which whether the compared image data are the same or different is determined, and a writing control circuit which does not to perform writing using the (n+1)th frame image data to a pixel in the mth row when the determination data indicates that the compared image data are the same, or to perform the writing using the (n+1)th frame image data to the pixel in the mth row when the determination data indicates that the compared image data are different. When performed in two or more successive frame periods, the writing to the pixel in the mth row is performed while video voltages having the same polarity are applied.

One embodiment of the present invention is a display device including a first memory device which stores one-frame image data, a second memory device which stores image data in one row, a comparator circuit which compares nth frame image data (n is a natural number) in an mth row (m is a natural number) in the first memory device and (n+1)th frame image data in the mth row in the second memory device and outputs determination data in which whether the compared image data are the same or different is determined, and a writing control circuit which does not select a gate line in the mth row in the display portion when the determination data indicates that the compared image data are the same, or to select the gate line in the mth row in the display portion and output the (n+1)th frame image data in the mth row to a data line of each column when the determination data indicates that the compared image data are different. When performed in two or more successive frame periods, writing using the (n+1)th frame image data is performed while video voltages having the same polarity are applied.

According to one embodiment of the present invention, a structure in which a video voltage is not written to pixels in the same row in successive frame periods can be obtained. Accordingly, power consumption can be reduced.

According to one embodiment of the present invention, image data of successive frame periods are compared row by row, that is, for each gate line, so that whether writing is performed or not can be determined. Accordingly, the structure of the memory device which holds data in successive frame periods can be simplified.

According to one embodiment of the present invention, the frequency of performing inversion driving when video voltages are written to each pixel can be reduced. Accordingly, it is possible to reduce the problem of an increase in the amount of video voltage change due to the inversion driving even when the magnitude of the video voltage applied to the display element is almost unchanged, which leads to lower power consumption.

BRIEF DESCRIPTION OF THE DRAWINGS

In the accompanying drawings:

FIGS. 9A1, 9A2, and 9B are top views and a cross-sectional view of a liquid crystal display device;

DETAILED DESCRIPTION OF THE INVENTION

Hereinafter, embodiments of the present invention will be described in detail with reference to the accompanying drawings. However, the present invention is not limited to the description below, and it is easily understood by those skilled in the art that modes and details disclosed herein can be modified in various ways without departing from the spirit and the scope of the present invention. Therefore, the present invention is not construed as being limited to description of the embodiments.

Embodiment 1

In this embodiment, one mode of a display device and one mode of a method of driving the display device are described with reference to FIGS. 1A to 1C, FIGS. 2A to 2C, FIG. 3, FIGS. 4A and 4B, FIGS. 5A and 5B, and FIG. 6.

Figure 1A:
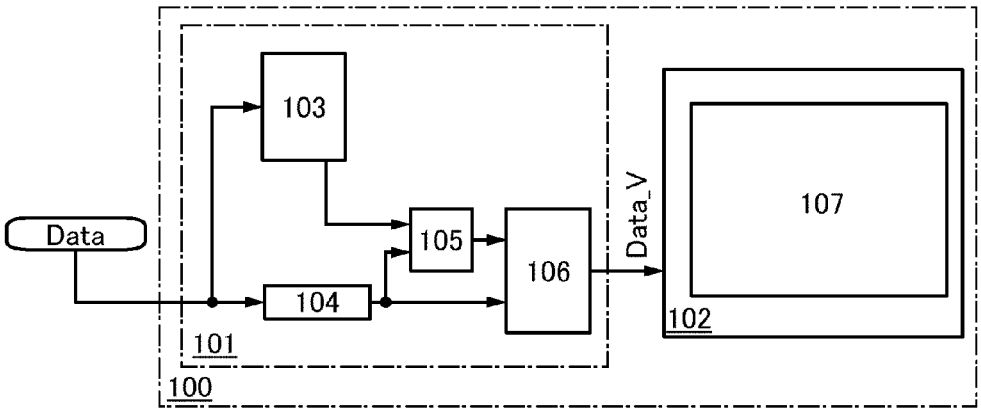
FIG. 1A is a block diagram illustrating one mode of a display device and FIGS. 1B and 1C are schematic views illustrating the operation.

A block diagram illustrating the mode of a display device is illustrated in FIG. 1A. A display device 100 in FIG. 1A includes an image data processing unit 101 and a display portion 102. The image data processing unit 101 includes a first memory device 103, a second memory device 104, a comparator circuit 105, and a writing control circuit 106. The display portion 102 includes a pixel portion 107.

In the image data processing unit 101, image data Data input from the outside is held and then converted into image data Data_V to be output to the display portion 102. Note that the image data Data and the image data Data_V are preferably digital signals.

In the display portion 102, the image data Data_V is input, and a video voltage based on the image data Data_V is written to a display element of each pixel.

In the first memory device 103, one-frame image data is stored. For example, nth frame image data (n is a natural number) can be stored in the first memory device 103. The first memory device 103 preferably has a first-in first-out (FIFO) memory configuration. A frame memory can also be used as the first memory device 103. Note that the nth frame image data which is stored in the first memory device 103 is changed into (n+1)th frame image data row by row. Further, the nth frame image data which is stored in the first memory device 103 is sequentially output to the comparator circuit 105 row by row. Note also that a plurality of first memory devices 103 may be provided so as to store image data of a plurality of frame periods.

In the second memory device 104, image data corresponding to one row of gate lines in the pixel portion 107 is stored. For example, (n+1)th frame image data in an mth row (m is a natural number) can be stored in the second memory device 104. As the second memory device 104, a line memory can be used. Note that the (n+1)th frame image data in the mth row which is stored in the second memory device 104 is sequentially output to the comparator circuit 105 and the first memory device 103 row by row. In the first memory device 103, the nth frame image data in the mth row is changed into the (n+1)th frame image data in the mth row which is stored in the second memory device 104.

The comparator circuit 105 compares the image data stored in the first memory device 103 and the image data stored in the second memory device 104, which correspond to image data in the same row, and outputs determination data in which whether sameness or difference is determined. For example, the comparator circuit 105 compares the (n+1)th frame image data in the mth row and the nth frame image data in the mth row, and outputs determination data in which whether sameness or difference is determined to the writing control circuit 106.

The sameness or difference of the image data is determined as follows. A bitwise exclusive OR (EX-OR) operation of image signals of both image data is performed, the sameness or difference is then determined bitwise for each pixel, and a negative OR (NOR) operation of determination results for the pixels is performed; thus, the determination data can be obtained.

The writing control circuit 106 outputs the image data Data_V to the display portion 102 in accordance with the determination data of the sameness or difference which is output from the comparator circuit 105. For example, when the determination data in the comparator circuit 105 indicates sameness, the writing control circuit 106 does not output the image data Data_V in the mth row. Alternatively, when the determination data in the comparator circuit 105 indicates difference, the writing control circuit 106 outputs, as the image data Data_V, the (n+1)th frame image data in the mth row in the display portion 102. In the case where the image data Data_V is output in two or more successive frame periods because the determination data in the comparator circuit 105 indicates difference, the writing control circuit 106 outputs the image data as the image data Data_V which is converted into video voltages having the same polarity.

A video voltage is a voltage that is based on image data for writing into each pixel through a data line and that is applied to one electrode of a display element such as a liquid crystal element. When the absolute value of a difference between a video voltage and a common potential is the same as that of a difference between another video voltage and the common potential, image data input to the display device is also the same as another image data input to the display device. Note that the polarities of video voltages applied to the display element are changed depending on which of the video voltage and the common potential is higher. For example, when the video voltage is higher than the common potential, a positive polarity voltage is applied to the display element; when the video voltage is lower than the common potential, a negative polarity voltage is applied to the display element.

In the pixel portion 107, pixels are provided in a matrix of m rows and k columns (k is a natural number). Each pixel includes a transistor functioning as a switching element connected to the gate line and to the data line and the display element connected to the transistor.

Figure 1B:
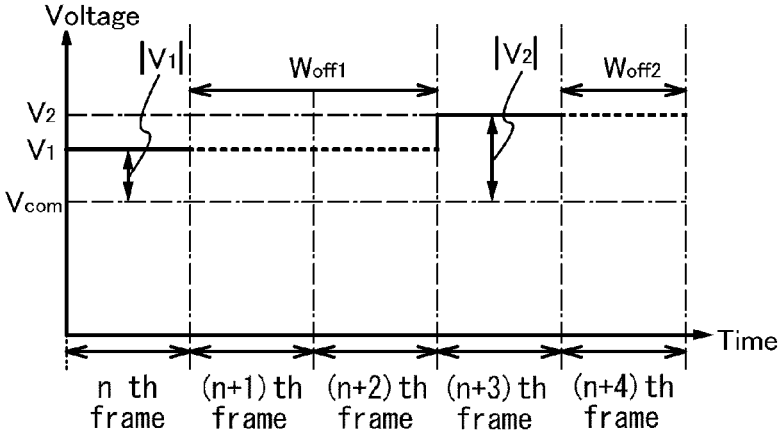
Figure 1C:
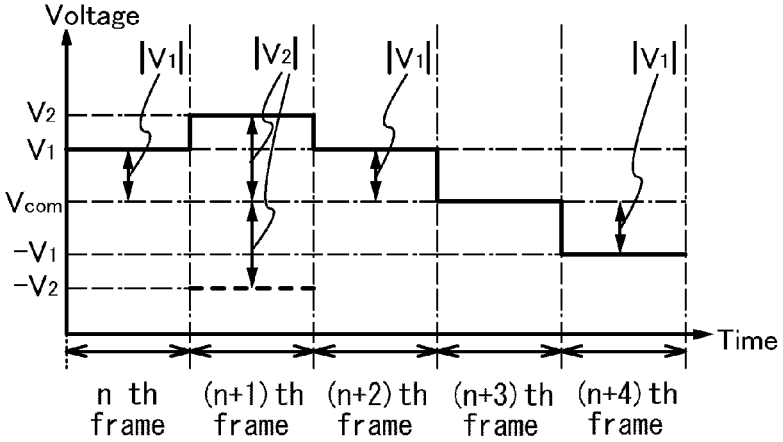

One example of the operation of the image data processing unit 101 is described using FIGS. 1B and 1C.

In FIGS. 1B and 1C, the horizontal axis represents time, and the vertical axis represents the magnitude of video voltages applied to the display element of the pixel. Along the horizontal axis in each of FIGS. 1B and 1C, the magnitudes of nth to (n+4)th frame video voltages written to the pixel in the mth row and the same column are represented in order. It is assumed in FIGS. 1B and 1C that only one column of a pixel is provided in the mth row. Hence, in FIGS. 1B and 1C, when the magnitudes of video voltages of adjacent frame periods are the same, the (n+1)th frame image data in the mth row and the nth frame image data in the mth row, which are compared in the comparator circuit 105, are the same. In FIGS. 1B and 1C, when the magnitudes of video voltages of adjacent frame periods are different from each other, the (n+1)th frame image data in the mth row and the nth frame image data in the mth row, which are compared in the comparator circuit 105, are different from each other.

It is assumed in FIG. 1B that the magnitude of an nth frame video voltage is $|V_1|$, the magnitude of an (n+1)th frame video voltage is $|V_1|$, the magnitude of an (n+2)th frame video voltage is $|V_1|$, the magnitude of an (n+3)th frame video voltage is $|V_2|$, and the magnitude of an (n+4)th frame video voltage is $|V_2|$. Note that $V_{com}$ denotes a common potential.

In FIG. 1B, the video voltage $V_1$ having a positive polarity continues to be supplied as the nth to (n+2)th frame video voltages. In FIG. 1B, the video voltage $V_2$ having a positive polarity continues to be supplied as the (n+3)th and (n+4)th frame video voltages. Note that the (n+3)th and (n+4)th frame video voltages have a positive polarity in FIG. 1B but may have a negative polarity.

In the case of FIG. 1B, by comparisons between the nth to (n+2)th frame image data in the mth row which are made in the comparator circuit 105, determination data indicating sameness is obtained. In this case, the writing control circuit 106 does not perform writing using the (n+1)th frame image data in the mth row in the display portion 102. Similarly, the writing control circuit 106 does not perform writing using the (n+2)th frame image data in the mth row in the display portion 102. Specifically, in the period of display using the (n+1)th and (n+2)th frame image data, a gate line in the mth row in the pixel portion 107 is not selected and a video voltage is not written into a display element included in a pixel. In the case of FIG. 1B, a period in which the image data is the same as the nth frame image data and the video voltage $V_1$ is not written again is a period $W_{off1}$ denoted by an arrow.

Further, in the case of FIG. 1B, by comparisons between the (n+3)th and (n+4)th frame image data in the mth row which are made in the comparator circuit 105, determination data indicating sameness is obtained. In this case, the writing control circuit 106 does not perform writing using the (n+4)th frame image data in the mth row in the display portion 102. Specifically, in the period of display using the (n+4)th frame image data, a gate line in an mth row in the pixel portion 107 is not selected and a video voltage is not written into a display element included in a pixel. In the case of FIG. 1B, a period in which the image data is the same as the (n+3)th frame image data and the video voltage $V_2$ is not written again is a period $W_{off2}$ denoted by an arrow.

In a structure of one embodiment of the present invention, on the basis of the determination data in which whether sameness or difference of the image data is determined in the comparator circuit 105, it is possible to set a period in which the writing control circuit 106 does not perform writing of a video voltage to the pixel in the same row, such as the period $W_{off1}$ and the period $W_{off2}$. Accordingly, power consumption can be reduced.

FIG. 1C is a schematic view illustrating changes in video voltage of successive frame periods, which is different from FIG. 1B.

It is assumed in FIG. 1C that the magnitude of the nth frame video voltage is $|V_1|$, the magnitude of the (n+1)th frame video voltage is $|V_2|$, the magnitude of the (n+2)th frame video voltage is $|V_1|$, the magnitude of the (n+3)th frame video voltage is 0, and the magnitude of the (n+4)th frame video voltage is $|V_1|$.

In FIG. 1C, the video voltage $V_1$ having a positive polarity is supplied as the nth frame video voltage. In FIG. 1C, the video voltage $V_2$ having a positive polarity is supplied as the (n+1)th frame video voltage. In FIG. 1C, the video voltage $V_1$ having a positive polarity is supplied as the (n+2)th frame video voltage. In FIG. 1C, $V_{com}$ is supplied as the (n+3)th frame video voltage. In FIG. 1C, the video voltage $-V_1$ having a negative polarity is supplied as the (n+4)th frame video voltage.

In general, in a display device using a liquid crystal element as a display element, inversion driving in which the polarity of a voltage applied to the display element is inverted every frame period, such as gate line inversion driving, source line inversion driving, frame inversion driving, or dot inversion driving, is employed. However, in the case where video voltages applied to a display element are high and inversion driving is performed, even when the magnitudes of the video voltages applied to the display element are almost unchanged, the amount of video voltage change increases and accordingly power consumption increases. The increase in power consumption is particularly problematic when the driving frequency is high.

Using an example in FIG. 1C, the above-mentioned increase in power consumption in inversion driving is described. To perform driving in which inversion is performed every frame period in the schematic view illustrating changes in the video voltages of the successive frame periods in FIG. 1C, the (n+1)th frame video voltage is a video voltage having a negative polarity (a video voltage $-V_2$ denoted by a thick dotted line) in FIG. 1C. In this case, since a video voltage having a negative polarity is applied, even when the image data is the same as that in the previous or subsequent frame period, a change in video voltage from that in the previous or subsequent frame period is larger than the case where a video voltage having a positive polarity is applied.

However, in a driving method illustrated in FIG. 1C, video voltages each having a positive polarity are applied to a display element in the nth to (n+2)th successive frames. In the method of driving a display device in this embodiment, the frequency of performing inversion driving when video voltages are written to each pixel can be reduced. In other words, instead of the driving in which inversion is performed every frame period, writing is performed by application of video voltages having the same polarity in two or more successive frame periods, as illustrated in FIG. 1C. Thus, it is possible to suppress the problem of an increase in the amount of video voltage change due to the inversion driving even when the magnitudes of the video voltages applied to a display element are almost unchanged, which occurs in driving in which inversion is performed every frame period; accordingly, power consumption can be reduced. Note that depending on a display element used for a display device, operation is possible without inversion driving, in which case power consumption can be further reduced.

Next, structures of the first memory device 103 and the second memory device 104, to each of which image data is input, are described using specific examples.

Figure 2A:
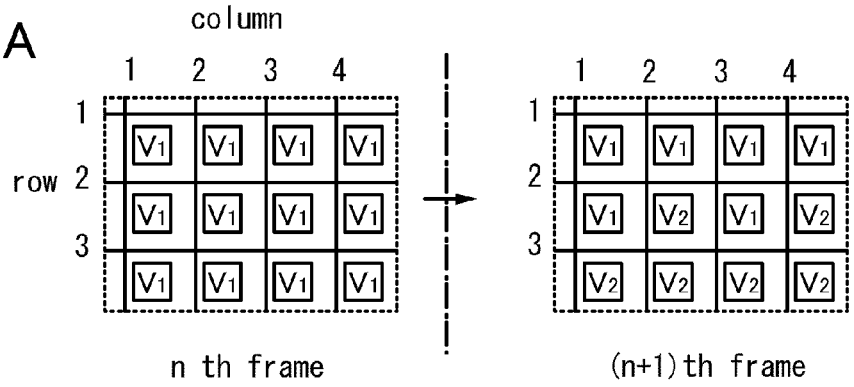
FIGS. 2A to 2C illustrate the operation of memory devices and a comparator circuit.

FIG. 2A is a schematic view of image data input to a pixel portion including pixels arranged in three rows and four columns, specifically illustrating image data input to the first memory device 103 and image data input to the second memory device 104. FIG. 2A illustrates a distribution of video voltages based on the nth frame image data and a distribution of video voltages based on the (n+1)th frame image data.

FIG. 2A illustrates an example in which the video voltage $V_1$, which is based on the nth frame image data, is input to the pixels arranged in three rows and four columns. FIG. 2A illustrates another example in which the video voltage $V_1$ and the video voltage $V_2$, which are based on the (n+1)th frame image data, are input to the pixels arranged in three rows and four columns.

Figure 2B:
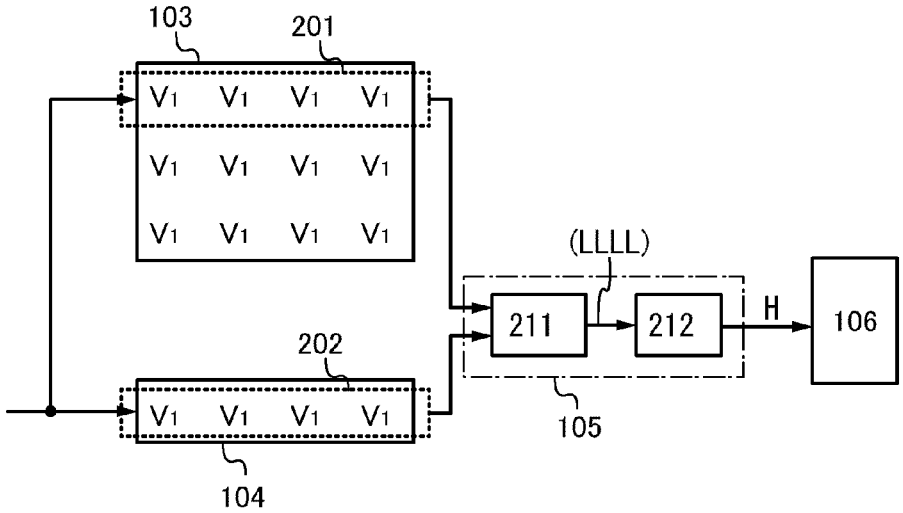

FIG. 2B is a schematic view illustrating the state where the nth frame image data and the (n+1)th frame image data, which are illustrated in FIG. 2A, are stored in the first memory device 103 and the second memory device 104, respectively. As illustrated in FIG. 2B, the nth frame image data is stored as one-frame image data in the first memory device 103. In addition, image data of the (n+1)th frame image data in the first row is stored as image data in one row in the second memory device 104.

The comparator circuit 105 illustrated in FIG. 2B includes an EX-OR circuit 211 and a NOR circuit 212. In the EX-OR circuit 211, the image data stored in the second memory device 104 and the image data in the first row which is stored in the first memory device 103 are read out, and an exclusive OR operation is performed.

For example, when the nth frame image data in the first row (image data enclosed by a dotted line 201 in FIG. 2B) and the (n+1)th frame image data in the first row (image data enclosed by a dotted line 202 in FIG. 2B) are compared, these image data are the same in all the columns. In this case, the EX-OR circuit 211 outputs a signal, "LLLL". The NOR circuit 212, to which the output of the EX-OR circuit 211 is input, outputs a signal, "H". This signal output from the NOR circuit 212 to the writing control circuit 106 is determination data and, in this case, a signal for the case where these image data are the same.

When the image data stored in the first memory device 103 and the image data stored in the second memory device 104 are multi-bit data, a bitwise comparison is made and an OR operation is performed, so that the sameness or difference of the image data is determined.

Figure 2C:
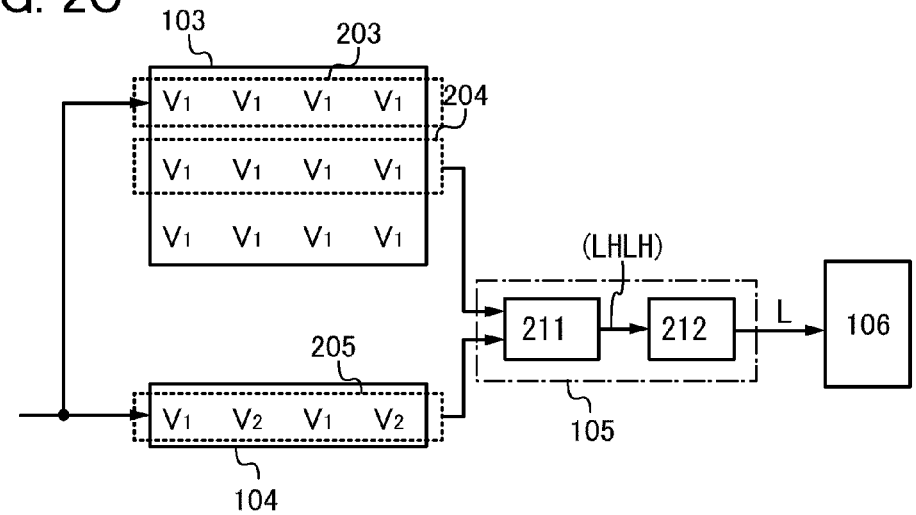

The (n+1)th frame image data in the mth row in the second memory device 104, which is used in the comparator circuit 105 in FIG. 2B, is overwritten to a region of the first memory device 103 where the nth frame image data in the mth row is stored, and stored (image data enclosed by a dotted line 203 in FIG. 2C). Then, the (n+1)th frame image data in the second row is input to the second memory device 104. Note that although a structure in which image data in one row is sequentially overwritten to the first memory device 103 is described in this embodiment, another structure may be employed. For example, the first memory device 103 may be used as a memory device for odd frames while another memory device is used as a memory device for even frames.

When the nth frame image data in the second row (image data enclosed by a dotted line 204 in FIG. 2C) and the (n+1)th frame image data in the second row (image data enclosed by a dotted line 205 in FIG. 2C) are compared, image data in the first column and image data in the third column are the same and image data in the second column and image data in the fourth column are different. In this case, the EX-OR circuit 211 outputs a signal, "LHLH". The NOR circuit 212, to which the output of the EX-OR circuit 211 is input, outputs a signal, "L". This signal output from the NOR circuit 212 to the writing control circuit 106 is determination data and, in this case, a signal for the case where these image data are different.

In the structure of this embodiment, image data is compared with the image data of the previous frame period row by row, that is, for each gate line, so that whether writing is performed or not can be determined. Thus, the memory devices holding image data of different frame periods can be a combination of a frame memory and a line memory, and hence the structure of the second memory device 104 can be simplified as compared with a structure in which frame periods are compared using a plurality of frame memories.

Next, a configuration of the writing control circuit 106 to which determination data is input from the comparator circuit 105 is described using a specific example.

Figure 3:
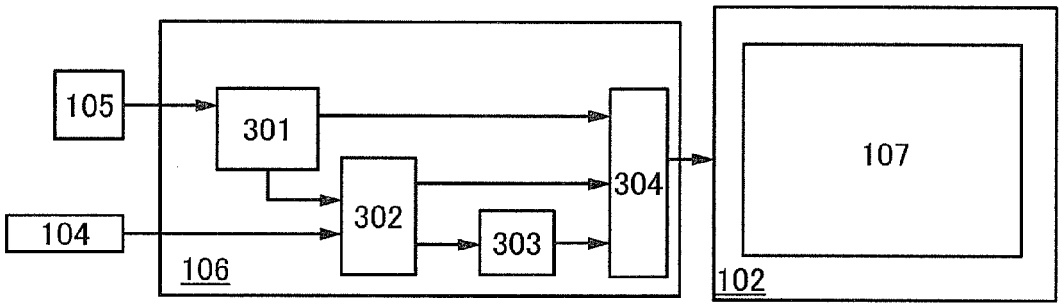
FIG. 3 is a flow chart illustrating one mode of a writing control circuit.

The writing control circuit 106 in FIG. 3 includes a rewriting determining circuit 301, a voltage change determining circuit 302, an inverted signal generation circuit 303, and a display control circuit 304.

The rewriting determining circuit 301 is a circuit that determines, in accordance with determination data input from the comparator circuit 105, whether or not image data in the row on which the determination is made is output. When the image data is output, the rewriting determining circuit 301 allows the image data to be output from the second memory device 104 to the display control circuit 304 through the voltage change determining circuit 302. When the image data is not output, the rewriting determining circuit 301 performs control so that the image data in the row is not output to the display control circuit 304 and a gate line of the row is not selected.

The voltage change determining circuit 302 is a circuit that monitors the polarities of video voltages based on image data, specifically a circuit that monitors the polarities of video voltages and performs control so that the polarities continue to be positive in two successive periods. In other words, the voltage change determining circuit 302 monitors changes in video voltage based on image data and performs control so that, when the polarities continue to be positive in two or more frame periods and a change in video voltage is large, the polarity of a video voltage is changed to be negative or so that, when the polarities continue to be positive in two or more frame periods and a change in video voltage is small, the polarity of a video voltages remains a positive polarity. This structure can suppress a large change in video voltage due to the inversion driving, so that power consumption can be reduced. Note that whether a change in video voltage is large or small can be determined by calculation using a half of the maximum video voltage as a reference.

The inverted signal generation circuit 303 is a circuit that makes a video voltage based on image data have a positive polarity or a negative polarity, on the basis of the control by the voltage change determining circuit 302.

The display control circuit 304 is a circuit that outputs image data data_V processed based on determination data for each row and a control signal for display in the display portion 102.

Next, a timing chart illustrating one example of a method of driving a display device according to the above-described structure of this embodiment is described.

Figure 4A:
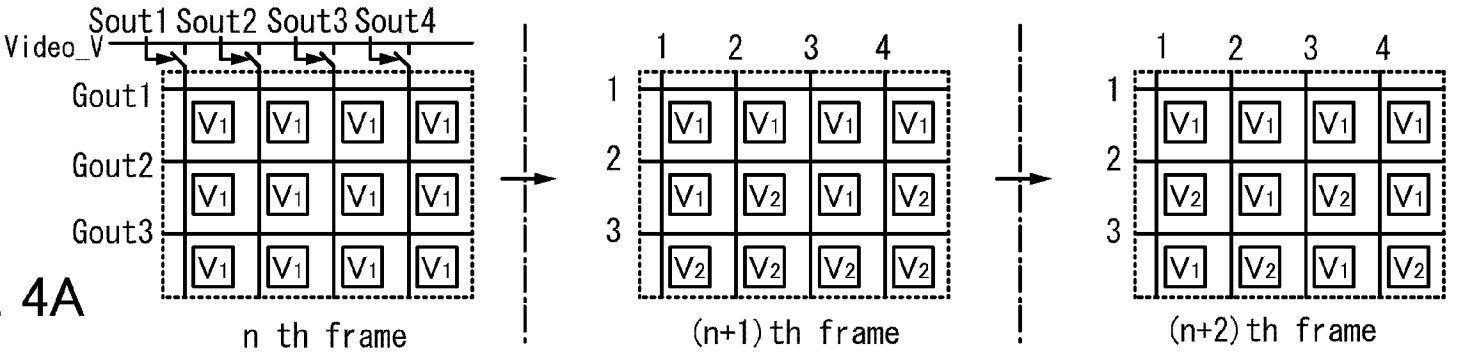
FIGS. 4A and 4B are a schematic view and a timing chart illustrating the operation of a display device.

First, FIG. 4A is a schematic view illustrating image data input to a pixel portion including pixels arranged in three rows and four columns, like FIG. 2A. FIG. 4A illustrates distributions of the nth to (n+2)th frame image data. Note that in FIG. 4A, scan signals input to gate lines of the pixel portion are referred to as Gout1, Gout2, and Gout3 in order from the first row. Further, switches connected to data lines are provided on the data line side of the pixel portion, and selection signals of the switches are referred to as Sout1, Sout2, Sout3, and Sout4 in order from the first row. When the above switch is turned on, a video voltage Video_V generated based on image data data_V is input to the corresponding data line.

Figure 4B:
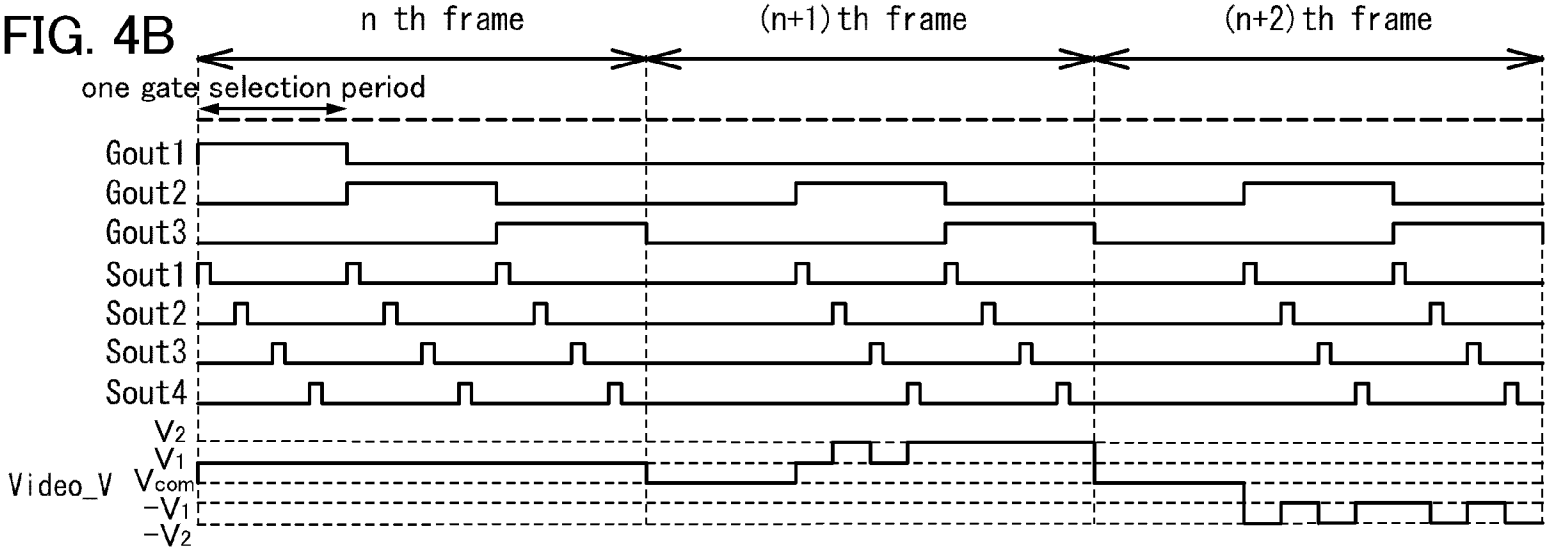

Next, FIG. 4B is a timing chart of the scan signals Gout1, Gout2, and Gout3, the selection signals Sout1, Sout2, Sout3, and Sout4, and the video voltage Video_V of the nth to (n+2)th frames.

It is assumed in the timing chart in FIG. 4B that no image data is written to each pixel before the nth frame. It is hence assumed that, in the nth frame, the image data processing unit 101 outputs image data data_V of the nth frame as it is and controls the scan signals and the selection signals so that $V_1$ which is the video voltage Video_V is written to each pixel.

Next, in the timing chart in FIG. 4B, the video voltage Video_V written in the (n+1)th frame is input. As described above, in the display device having the structure of this embodiment, writing of a video voltage using image data to pixels in the mth row in the display portion is not performed when determination data indicates sameness, and writing of a video voltage using image data to pixels in the mth row in the display portion is performed when determination data indicates difference. Further, in the display device having the structure of this embodiment, when image data is written in two or more successive frame periods, video voltages having the same polarity are applied. In accordance with the above-described control, the image data processing unit 101 performs control so that the video voltage Video_V in the first row for which determination data indicates sameness is not written and so that the video voltage Video_V based on image data data_V in the second and third rows for which determination data indicates difference is output as a video voltage having a positive polarity.

Next, in the timing chart in FIG. 4B, the video voltage Video_V written in the (n+2)th frame is input. In accordance with the control in the above-described structure of the display device having the structure of this embodiment, the image data processing unit 101 performs control so that image data in the first row for which determination data indicates sameness is not output, and so that inversion driving is performed in which the positive polarity of the video voltage Video_V based on the image data data_V in the second and third rows for which determination data indicates difference is changed to a negative polarity.

Figure 5A:
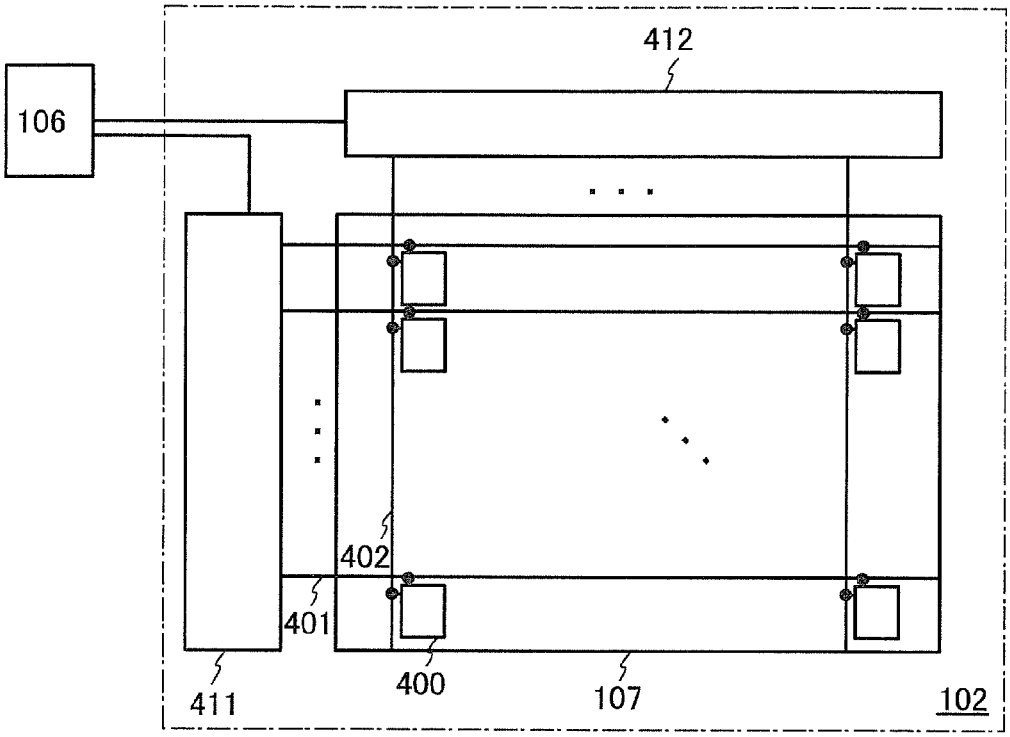
FIG. 5A is a block diagram of a liquid crystal display device and FIG. 5B is a circuit diagram of a pixel.
Figure 5B:
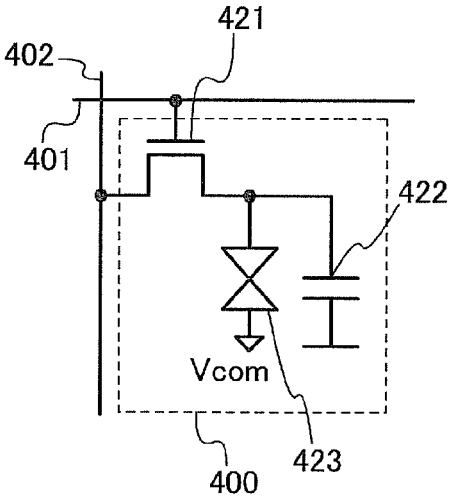
Figure 6:
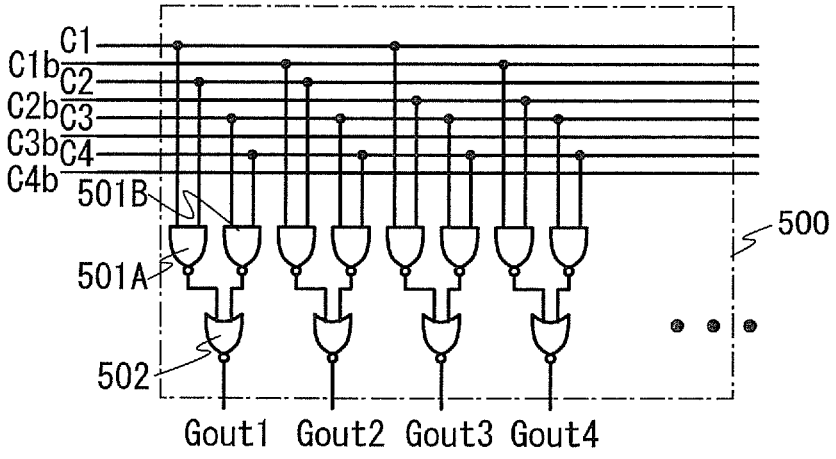
FIG. 6 is a circuit diagram of a gate line driver circuit.

Next, configurations of the display portion 102 and the pixel portion 107 are described using FIGS. 5A and 5B and FIG. 6.

The display portion 102 in FIG. 5A includes the pixel portion 107, a gate line driver circuit 411, and a data line driver circuit 412. The pixel portion 107 includes a plurality of pixels 400, a plurality of gate lines 401, and a plurality of data lines 402. Note that in FIG. 5A, a decoder circuit in the gate line driver circuit 411 can select the gate lines 401 row by row so that writing of a video voltage is controlled.

FIG. 5B illustrates one example of a circuit of the pixel 400 illustrated in FIG. 5A. The pixel 400 in FIG. 5B includes a transistor 421 having a gate connected to the gate line 401, a source and a drain, one of which is connected to the data line 402. The pixel 400 also includes a capacitor 422 having electrodes one of which is connected to the other of the source and the drain of the transistor 421 and the other of which is connected to a storage capacitor line. The pixel 400 also includes a liquid crystal element 423 having electrodes one of which (also referred to as a pixel electrode) is connected to the other of the source and the drain of the transistor 421 and to the one of the electrodes of the capacitor 422, and the other of which (also referred to as a counter electrode) is connected to a wiring through which a common potential ($V_{com}$) is supplied. Note that the transistor 421 is an n-channel transistor.

FIG. 6 illustrates an example of the decoder circuit. A decoder circuit 500 inputs address signals through address lines C1, C1*b*, C2, C2*b*, C3, C3*b*, C4, and C4*b* to a NAND circuit 501A and a NAND circuit 501B and outputs the address signals as the scan signal Gout1 through a NOR circuit 502. In the configuration in FIG. 6, by controlling the potentials of the address lines, the scan signal Gout1 enables pixels in each row to be selectively controlled.

According to the above-described structure of this embodiment, a structure in which a video voltage is not written to pixels in the same row can be obtained. Accordingly, power consumption can be reduced.

Further, according to the structure of this embodiment, image data is compared with the image data of the previous frame period row by row, that is, for each gate line, so that whether writing is performed or not can be determined. Thus, the memory device holding image data of different frame periods can be simplified.

Further, according to the structure of this embodiment, the frequency of performing inversion driving when video voltages are written to each pixel can be reduced. Accordingly, it is possible to reduce the problem of an increase in the amount of video voltage change due to the inversion driving even when the magnitude of the video voltage are almost unchanged, which leads to lower power consumption.

Embodiment 2

In this embodiment, a structure is described in which a comparison is made pixel by pixel to determine sameness or difference of image data of successive frame periods and, in accordance with a comparison result, writing of a video voltage to the display portion is controlled.

The structure for comparison between frame periods is substantially the same as the structure described in Embodiment 1. In the structure of this embodiment, a comparison between frame periods is made pixel by pixel. Based on determination data obtained by the comparison, whether a video voltage is written to a pixel or not is decided.

Figure 7A:
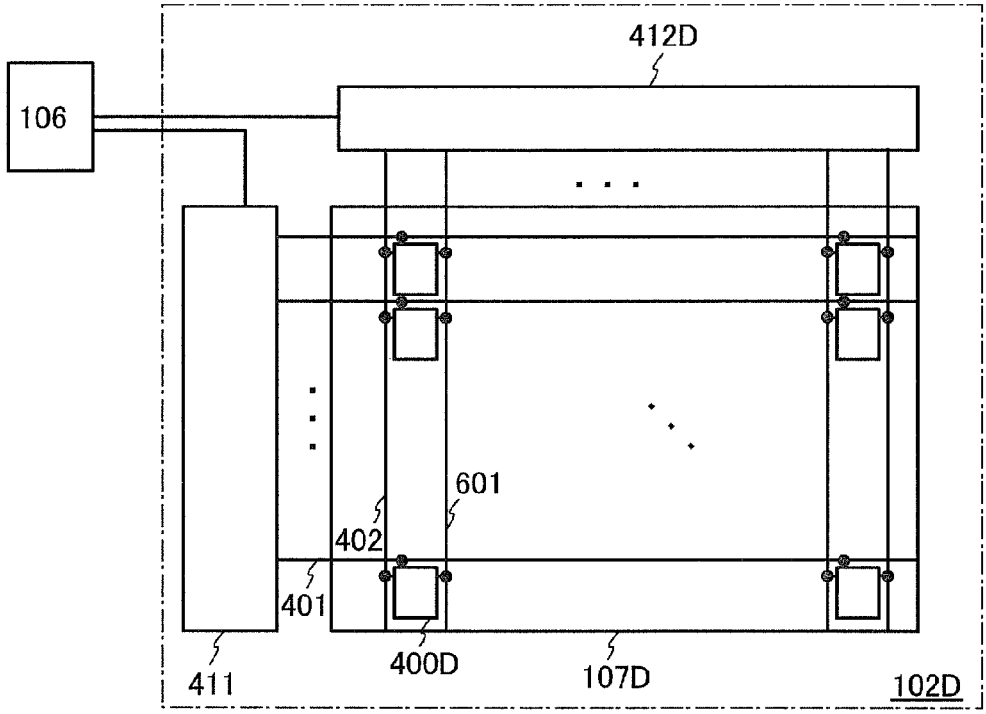
FIG. 7A is a block diagram of a liquid crystal display device and FIG. 7B is a circuit diagram of a pixel.
Figure 7B:
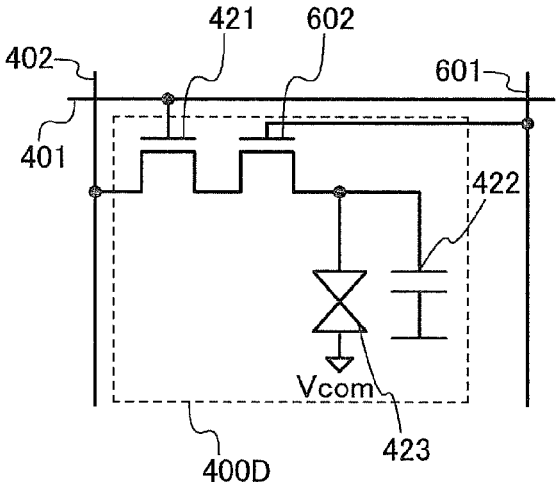
Figure 8:
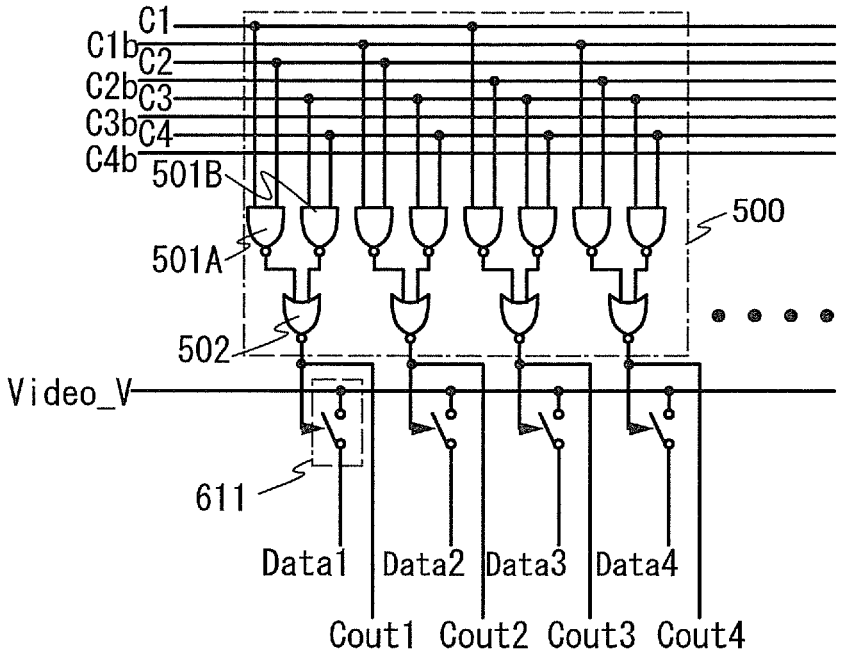
FIG. 8 is a circuit diagram of a data line driver circuit.

Next, configurations of a display portion 102D and a pixel portion 107D, in which whether a video voltage is written to a pixel or not can be decided pixel by pixel, are described using FIGS. 7A and 7B and FIG. 8.

The display portion 102D in FIG. 7A includes the pixel portion 107D, the gate line driver circuit 411, and a data line driver circuit 412D. The pixel portion 107D includes a plurality of pixels 400D, the plurality of gate lines 401, the plurality of data lines 402, and a plurality of selection lines 601. Note that in FIG. 7A, the data line driver circuit 412D includes a decoder circuit. The decoder circuit included in the data line driver circuit 412D can select the data lines 402 column by column so that a video voltage can be written. In addition, the decoder circuit included in the data line driver circuit 412D can control the selection line 601 so that a predetermined pixel can be selected and the video voltage can be written thereto.

FIG. 7B illustrates one example of a circuit of the pixel 400D illustrated in FIG. 7A. The pixel 400D in FIG. 7B includes the transistor 421 having a gate connected to the gate line 401, a source and a drain, one of which is connected to the data line 402. The pixel 400D also includes a transistor 602 having a gate connected to the selection line 601, a source and a drain, one of which is connected to the other of the source and the drain of the transistor 421. The pixel 400D further includes the capacitor 422 having electrodes one of which is connected to the other of the source and the drain of the transistor 602 and the other of which is connected to a storage capacitor line. The pixel 400D also includes the liquid crystal element 423 having electrodes one of which (also referred to as a pixel electrode) is connected to the other of the source and the drain of the transistor 421 and to the one of the electrodes of the capacitor 422, and the other of which (also referred to as a counter electrode) is connected to a wiring through which a common potential ($V_{com}$) is supplied. Note that the transistors 421 and 602 are n-channel transistors.

In the pixel 400D illustrated in FIG. 7B, the transistor 421 serving as a switching element is turned on for selection of pixels in the row direction, and at the same time, the transistor 602 serving as a switching element is turned on for selection of pixels in the column direction. Consequently, a video voltage can be written to a predetermined pixel.

FIG. 8 illustrates an example of the data line driver circuit 412 having the decoder circuit. The decoder circuit 500 inputs address signals through the address lines C1, C1*b*, C2, C2*b*, C3, C3*b*, C4, and C4*b* to the NAND circuit 501A and the NAND circuit 501B and outputs the address signals as a signal controlling the on/off of a switch 611 and as a selection signal Cout1 through the NOR circuit 502. One terminal of the switch 611 is connected to a wiring through which the video voltage Video_V is supplied, and the other terminal of the switch 611 is connected to a data line to which a data signal Data1 is supplied. In the configuration in FIG. 8, by controlling the potentials of the address lines, control can be performed with the scan signal Gout1, the selection signal Cout, and the data signal Data1 so that a video voltage can be selectively written to a pixel in each row and each column.

This embodiment can be implemented in appropriate combination with any of the structures described in the other embodiments.

Embodiment 3

In this embodiment, an external view, a cross section, and the like of the display device are illustrated and a structure thereof is described. In this embodiment, an example in which a liquid crystal element is used as the display element is given.

Note that the term liquid crystal display device includes any of the following modules in its category: a module provided with a connector, for example, a flexible printed circuit (FPC), a tape automated bonding (TAB) tape, or a tape carrier package (TCP); a module provided with a printed wiring board at the end of a TAB tape or a TCP; and a module where an integrated circuit (IC) is directly mounted on a display element by a chip on glass (COG) method.

Figure 9B:
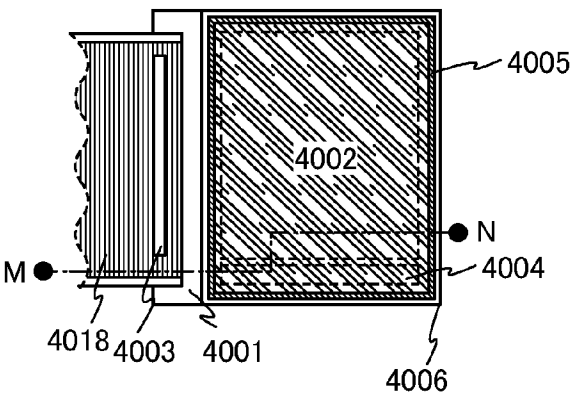
Figure 9B:
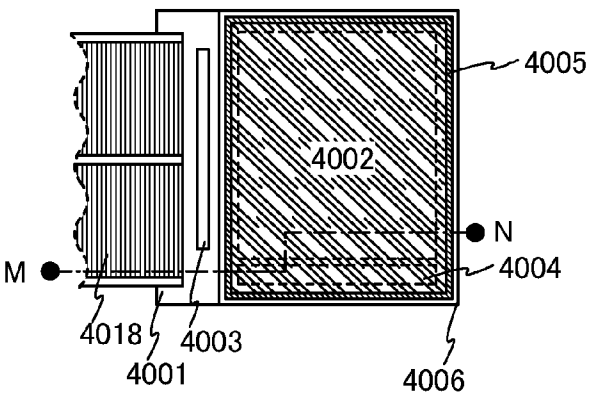
Figure 9B:
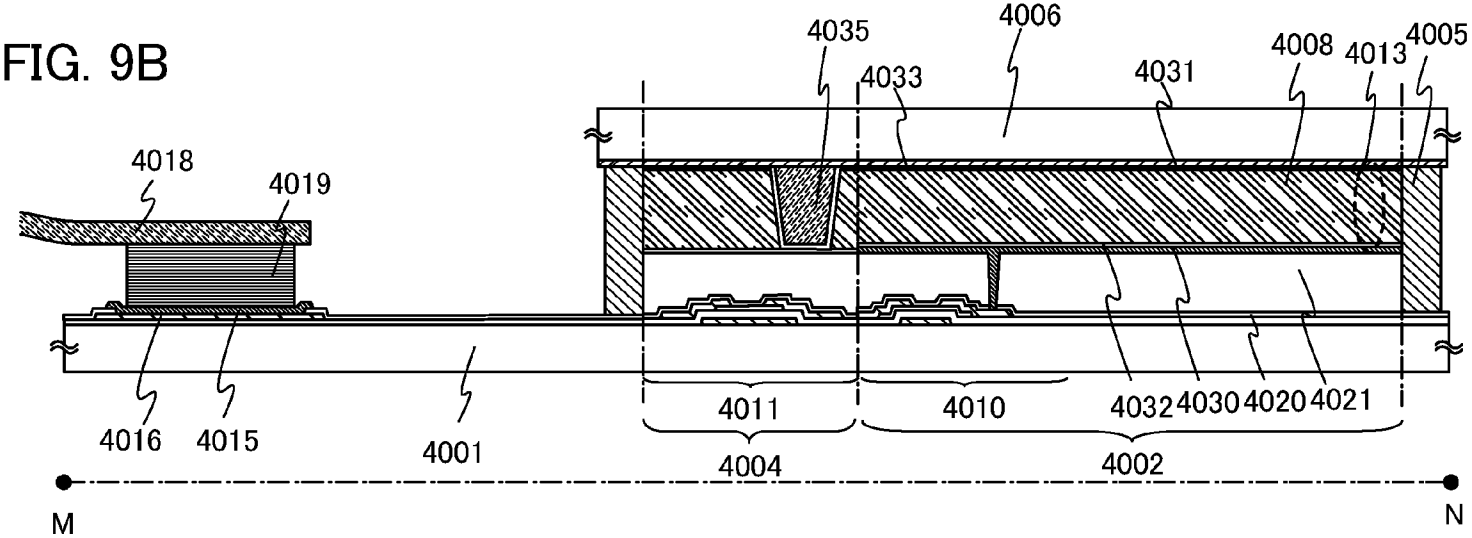

An external view and a cross section of a liquid crystal display device are described with reference to FIGS. 9A1, 9A2, and 9B. FIGS. 9A1 and 9A2 are plan views of a panel in which transistors 4010 and 4011 and a liquid crystal element 4013 are sealed between a first substrate 4001 and a second substrate 4006 with a sealant 4005. FIG. 9B is a cross-sectional view taken along a line M-N of FIGS. 9A1 and 9A2.

The sealant 4005 is provided so as to surround a pixel portion 4002 and a gate line driver circuit 4004 which are provided over the first substrate 4001. The second substrate 4006 is provided over the pixel portion 4002 and the gate line driver circuit 4004. Therefore, the pixel portion 4002 and the gate line driver circuit 4004 are sealed together with a liquid crystal layer 4008, by the first substrate 4001, the sealant 4005, and the second substrate 4006. A data line driver circuit 4003 that is formed using a single crystal semiconductor film or a polycrystalline semiconductor film over a substrate separately prepared is mounted in a region that is different from the region surrounded by the sealant 4005 over the first substrate 4001.

Note that there is no particular limitation on the connection method of a driver circuit which is separately formed, and a COG method, a wire bonding method, a TAB method, or the like can be used. FIG. 9A1 illustrates an example of mounting the data line driver circuit 4003 by a COG method, and FIG. 9A2 illustrates an example of mounting the data line driver circuit 4003 by a TAB method.

The pixel portion 4002 and the gate line driver circuit 4004 provided over the first substrate 4001 include a plurality of transistors. FIG. 9B illustrates the transistor 4010 included in the pixel portion 4002 and the transistor 4011 included in the gate line driver circuit 4004. Over the transistors 4010 and 4011, insulating layers 4020 and 4021 are provided.

In each of the transistors 4010 and 4011, a semiconductor thin film of silicon, germanium, or the like in an amorphous, microcrystalline, polycrystalline, or single crystal state can be used as a semiconductor layer. Alternatively, in each of the transistors 4010 and 4011, an oxide semiconductor can be used for a semiconductor layer. In this embodiment, the transistors 4010 and 4011 are n-channel transistors.

As each of the transistors 4010 and 4011, in particular, a transistor having a low current (low off-state current) which flows between a source and a drain in a non-conducting state is preferably used. Here, the "low off-state current" means that the normalized off-state current per micrometer of a channel width with a drain-source voltage of 10 V at room temperature is less than or equal to 10 zA. An example of a transistor having such a low off-state current is a transistor including an oxide semiconductor as a semiconductor layer.

As described in the above embodiment, in the structure of the display device of this embodiment, a written video voltage can be held by holding a non-conducting state. Hence, to hold a written video voltage, a transistor having a low off-state current is particularly preferably used as a transistor which suppresses variation in potential which is accompanied by transport of charge.

A pixel electrode layer 4030 included in the liquid crystal element 4013 is connected to the transistor 4010. The second substrate 4006 is provided with a counter electrode layer 4031 of the liquid crystal element 4013. A portion where the pixel electrode layer 4030, the counter electrode layer 4031, and the liquid crystal layer 4008 overlap with one another corresponds to the liquid crystal element 4013. Note that the pixel electrode layer 4030 and the counter electrode layer 4031 are provided with an insulating layer 4032 and an insulating layer 4033, respectively, which each function as an alignment film, and the liquid crystal layer 4008 is interposed between the pixel electrode layer 4030 and the counter electrode layer 4031 with the insulating layers 4032 and 4033 therebetween.

Note that a light-transmitting substrate can be used as the first substrate 4001 and the second substrate 4006; glass, ceramics, or plastics can be used. As plastic, a fiberglass-reinforced plastics (FRP) plate, a polyvinyl fluoride (PVF) film, a polyester film, or an acrylic resin film can be used.

A structure body 4035 is a columnar spacer obtained by selectively etching an insulating film and is provided to control the distance (cell gap) between the pixel electrode layer 4030 and the counter electrode layer 4031. Alternatively, a spherical spacer may also be used. In addition, the counter electrode layer 4031 is connected to a common potential line formed over the same substrate as the transistor 4010. With use of the common contact portion, the counter electrode layer 4031 and the common potential line can be connected to each other by conductive particles arranged between a pair of substrates. Note that the conductive particles can be included in the sealant 4005.

Note that as a display mode of the liquid crystal element, any of the following can be used: a twisted nematic (TN) mode, an in-plane-switching (IPS) mode, a fringe field switching (FFS) mode, a multi-domain vertical alignment (MVA) mode, a patterned vertical alignment (PVA) mode, an axially symmetric aligned micro-cell (ASM) mode, an optically compensated birefringence (OCB) mode, a ferroelectric liquid crystal (FLC) mode, an anti-ferroelectric liquid crystal (AFLC) mode, and the like. Note that the electrode structure or the like in the liquid crystal display device can be changed as appropriate in accordance with the display mode.

Alternatively, liquid crystal exhibiting a blue phase for which an alignment film is unnecessary may be used. A blue phase is one of liquid crystal phases, which is generated just before a cholesteric phase changes into an isotropic phase while temperature of cholesteric liquid crystal is increased. Since the blue phase is generated within an only narrow range of temperature, liquid crystal composition containing a chiral material at 5 wt % or more so as to improve the temperature range is used for the liquid crystal layer 4008. The liquid crystal composition which includes a liquid crystal showing a blue phase and a chiral material has a short response time of 1 msec or less and has optical isotropy, which makes the alignment process unnecessary and the viewing angle dependence small.

Note that this embodiment can also be applied to a transflective liquid crystal display device in addition to a transmissive liquid crystal display device.

This embodiment shows the example of the liquid crystal display device in which a polarizing plate is provided on the outer side of the substrate (on the viewer side) and a coloring layer and an electrode layer used for a display element are provided in this order on the inner side of the substrate; alternatively, a polarizing plate may be provided on the inner side of the substrate. The stacked structure of the polarizing plate and the coloring layer is not limited to that in this embodiment and may be set as appropriate depending on materials of the polarizing plate and the coloring layer or conditions of manufacturing process. Further, a light-blocking film serving as a black matrix may be provided in a portion other than the display portion.

The transistors 4010 and 4011 each includes a gate insulating layer, a gate electrode layer, and a wiring layer (e.g., a source wiring layer or a capacitor wiring layer), in addition to the semiconductor layer.

The insulating layer 4020 is formed over the transistors 4010 and 4011. As the insulating layer 4020, a silicon nitride film is formed by an RF sputtering method, for example.

The insulating layer 4021 is formed as the planarizing insulating film. As the insulating layer 4021, an organic material having heat resistance such as polyimide, acrylic, a benzocyclobutene-based resin, polyamide, or epoxy can be used. Other than such organic materials, it is also possible to use a low-dielectric constant material (a low-k material), a siloxane-based resin, PSG (phosphosilicate glass), BPSG (borophosphosilicate glass), or the like. Note that the insulating layer 4021 may be formed by stacking a plurality of insulating films formed of these materials.

The pixel electrode layer 4030 and the counter electrode layer 4031 can be formed using a light-transmitting conductive material such as indium oxide containing tungsten oxide, indium zinc oxide containing tungsten oxide, indium oxide containing titanium oxide, indium tin oxide containing titanium oxide, indium tin oxide, indium zinc oxide, or indium tin oxide to which silicon oxide is added.

A π-electron conjugated conductive polymer can be used as the pixel electrode layer 4030 and the counter electrode layer 4031. For example, polyaniline or a derivative thereof, polypyrrole or a derivative thereof, polythiophene or a derivative thereof, a copolymer of two or more of aniline, pyrrole, and thiophene or a derivative thereof can be given.

Further, a variety of signals and potentials are supplied to the data line driver circuit 4003 which is formed separately, the gate line driver circuit 4004, or the pixel portion 4002 from an FPC 4018.

A connection terminal electrode 4015 is formed with the same conductive film as that of the pixel electrode layer 4030 included in the liquid crystal element 4013, and a terminal electrode 4016 is formed with the same conductive film as that of the source and drain electrode layers of the transistors 4010 and 4011.

The connection terminal electrode 4015 is electrically connected to a terminal included in the FPC 4018 via an anisotropic conductive film 4019.

FIGS. 9A1, 9A2, and 9B illustrate an example in which the data line driver circuit 4003 is formed separately and mounted on the first substrate 4001; however, this embodiment is not limited to this structure. The gate line driver circuit may be separately formed and then mounted, or only part of the data line driver circuit or part of the gate line driver circuit may be separately formed and then mounted.

This embodiment can be implemented in appropriate combination with any of the structures described in the other embodiments.

Embodiment 4

In this embodiment, examples of electronic devices including the display device described in any of the above embodiments are described.

Figure 10A:
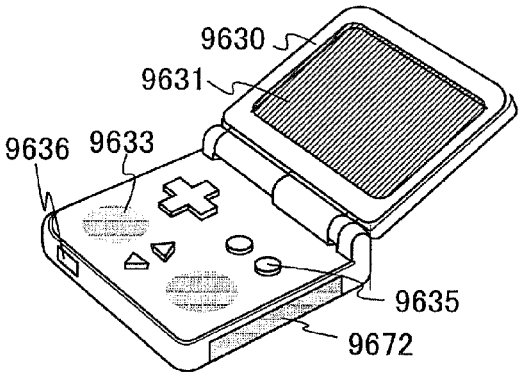
FIGS. 10A to 10C illustrate electronic devices.

FIG. 10A illustrates a portable game machine which can include a housing 9630, a display portion 9631, speakers 9633, operation keys 9635, a connection terminal 9636, a recording medium reading portion 9672, and the like. The portable game machine illustrated in FIG. 10A can have a function of reading a program or data stored in a recording medium to display it on the display portion, a function of sharing data by wireless communication with another portable game machine, and the like. The portable game machine in FIG. 10A can have various functions without limitation to the above.

Figure 10B:
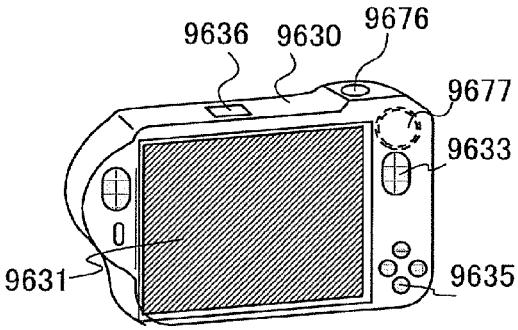

FIG. 10B illustrates a digital camera which can include a housing 9630, a display portion 9631, speakers 9633, operation keys 9635, a connection terminal 9636, a shutter button 9676, an image receiving portion 9677, and the like. The digital camera having a television reception function, which is illustrated in FIG. 10B, can have various functions such as a function of shooting a still image, a function of shooting a moving image, a function of automatically or manually adjusting the shot image, a function of obtaining various kinds of data from an antenna, a function of storing the shot image or the data obtained from the antenna, and a function of displaying the shot image or the data obtained from the antenna on the display portion. Note that the functions of the digital camera having a television reception function, which is illustrated in FIG. 10B, are not limited to those, and the digital camera can have other various functions.

Figure 10C:
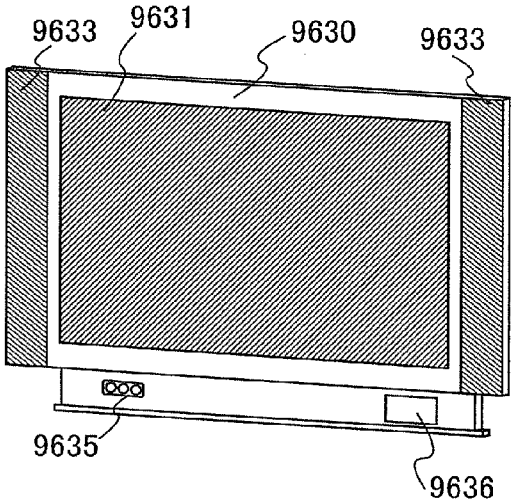

FIG. 10C illustrates a television set which can include a housing 9630, a display portion 9631, speakers 9633, operation keys 9635, a connection terminal 9636, and the like. The television set shown in FIG. 10C has a function of processing electric waves for television and converting the electric waves into an image signal, a function of processing the image signal and converting the image signal into a signal suitable for display, a function of converting a frame frequency of the image signal, and the like. Note that the television set illustrated in FIG. 10C can have a variety of functions without limitation to the above.

Figure 11A:
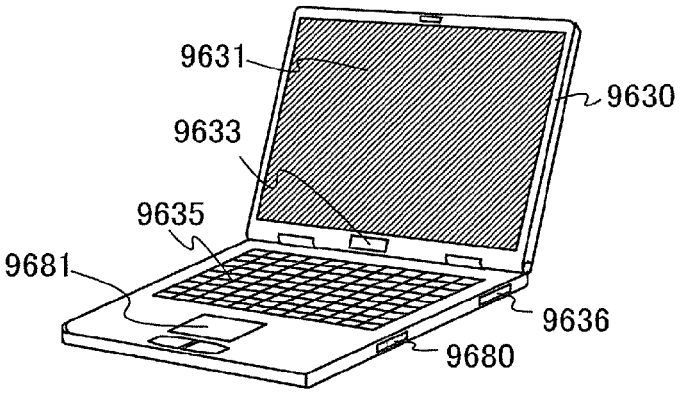
FIGS. 11A to 11C illustrate electronic devices.

FIG. 11A illustrates a computer which can include a housing 9630, a display portion 9631, a speaker 9633, operation keys 9635, a connection terminal 9636, a pointing device 9681, an external connecting port 9680, and the like. The computer illustrated in FIG. 11A can have a function of displaying a variety of kinds of data (e.g., a still image, a moving image, and a text image) on the display portion, a function of controlling processing by a variety of kinds of software (programs), a communication function such as wireless communication or wire communication, a function of connecting to various computer networks with the use of the communication function, a function of transmitting or receiving a variety of kinds of data with the use of the communication function, and the like. Note that the functions of the computer illustrated in FIG. 11A are not limited to those, and the computer can have other various functions.

Figure 11B:
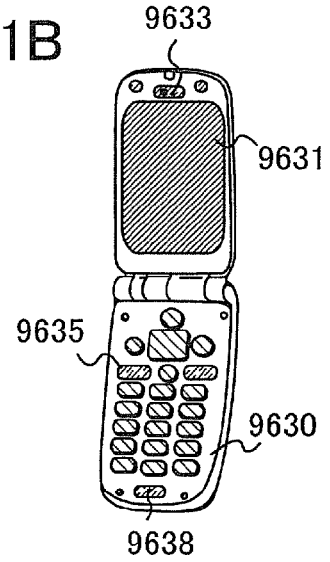

FIG. 11B illustrates a mobile phone which can include a housing 9630, a display portion 9631, a speaker 9633, operation keys 9635, a microphone 9638, an external connection port 9680, and the like. The mobile phone illustrated in FIG. 11B can have a function of displaying a variety of kinds of data (e.g., a still image, a moving image, and a text image) on the display portion, a function of displaying a calendar, a date, the time, and the like on the display portion, a function of operating or editing the data displayed on the display portion, a function of controlling processing by various kinds of software (programs), and the like. Note that the mobile phone illustrated in FIG. 11B can have other various functions without limitation to the above.

Figure 11C:
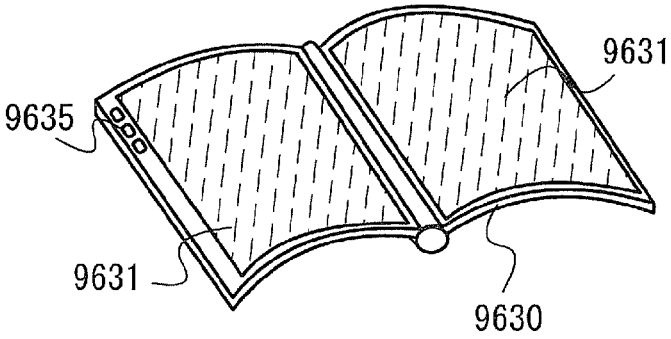

FIG. 11C illustrates electronic paper (also referred to as an eBook or an e-book reader) that can include a housing 9630, a display portion 9631, operation keys 9635, and the like. The electronic paper in FIG. 11C can have a function of displaying a variety of kinds of data (e.g., a still image, a moving image, and a text image) on the display portion, a function of displaying a calendar, a date, the time, and the like on the display portion, a function of operating or editing the data displayed on the display portion, a function of controlling processing with the use of various kinds of software (programs), and the like. Note that the electronic paper in FIG. 11C can have other various functions without limitation to the above.

In the electronic devices described in this embodiment, low power consumption can be achieved by including the display device described in any of the above embodiments.

This embodiment can be implemented in appropriate combination with any of the structures described in the other embodiments.

This application is based on Japanese Patent Application serial no. 2012-147337 filed with the Japan Patent Office on Jun. 29, 2012, the entire contents of which are hereby incorporated by reference.

What is claimed is:

1. A display device comprising:

a pixel portion including a plurality of gate lines arranged in a plurality of rows;

a first memory device which is a frame memory, the frame memory being capable of storing an nth frame image data (n is a natural number);

a second memory device which is a line memory, the line memory being capable of storing an (n+1)th frame image data in an mth row (m is a natural number);

a comparator circuit configured to compare the nth frame image data and the (n+1)th frame image data row by row, and generate a plurality of determination data each corresponding to one of the plurality of rows; and a writing control circuit configured to control a selection of the plurality of gate lines row by row in each frame period, based on the plurality of determination data supplied from the comparator circuit, wherein each of the plurality of determination data indicates whether the nth frame image data in one of the plurality of rows and the (n+1)th frame image data in a corresponding row are the same or different, wherein, when one of the plurality of determination data indicates that a first data which is the nth frame image data in the mth row and a second data which is the (n+1)th frame image data in the mth row are the same, the writing control circuit does not select the gate line in the mth row, wherein, when the one of the plurality of determination data indicates that the first data and the second data are different, the writing control circuit selects the gate line in the mth row, wherein the second memory device supplies the (n+1)th frame image data in the mth row to the first memory device so that the nth frame image data in the mth row is overwritten with the (n+1)th frame image data in the mth row in the first memory device, and wherein a number of the plurality of rows is the same as a number of the plurality of determination data which are generated by comparing the nth frame image data and the (n+1)th frame image data.

2. The display device according to claim 1, wherein the display device further comprises a driver circuit electrically connected to the pixel portion, wherein, when one of the plurality of determination data indicates that the first data and the second data are the same, the writing control circuit controls the driver circuit so that the second data is not written to the pixel portion, and wherein, when the one of the plurality of determination data indicates that the first data and the second data are different, the writing control circuit controls the driver circuit so that the second data is written to the pixel portion.

3. The display device according to claim 1, wherein, when the gate line in the mth row is selected in two or more successive frame periods, video voltages having same polarity are input to the pixel portion in the two or more successive frame periods.

4. The display device according to claim 1, wherein the pixel portion comprises a plurality of pixels arranged in the plurality of rows, wherein each of the plurality of pixels comprises a transistor and a liquid crystal element, and wherein a channel formation region of the transistor comprises an oxide semiconductor.

5. The display device according to claim 1, wherein the pixel portion comprises a plurality of pixels arranged in the plurality of rows, wherein each of the plurality of pixels comprises a transistor and a liquid crystal element, wherein a channel formation region of the transistor comprises an oxide semiconductor, and wherein an off-state current per micrometer of a channel width of the transistor is less than or equal to 10 zA.

6. The display device according to claim 1, wherein the pixel portion comprises a plurality of pixels arranged in the plurality of rows, wherein each of the plurality of pixels comprises a transistor and a liquid crystal element, wherein a channel formation region of the transistor comprises an oxide semiconductor, and wherein an off-state current per micrometer of a channel width of the transistor is less than or equal to 10 zA at room temperature when a voltage between a source and a drain of the transistor is 10 V.

7. The display device according to claim 1, wherein the pixel portion comprises a plurality of pixels arranged in the plurality of rows, wherein each of the plurality of pixels comprises a first transistor, a second transistor, and a liquid crystal element, wherein a gate of the first transistor is electrically connected to one of the plurality of gate lines, and wherein a gate of the second transistor is electrically connected to a selection line.

8. The display device according to claim 1, wherein the comparator circuit comprises a first logic circuit and a second logic circuit which are electrically connected in series.

9. A driving method of a display device, the display device comprising:

a pixel portion including a plurality of gate lines arranged in a plurality of rows;

a first memory device which is a frame memory, the frame memory being capable of storing an nth frame image data (n is a natural number);

a second memory device which is a line memory, the line memory being capable of storing an (n+1)th frame image data in an mth row (m is a natural number);

a comparator circuit; and a writing control circuit, the driving method comprising steps of:

storing the nth frame image data (n is a natural number) in the first memory device;

storing the (n+1)th frame image data in the mth row (m is a natural number) in the second memory device;

comparing the nth frame image data and the (n+1)th frame image data row by row in the comparator circuit;

generating a plurality of determination data each corresponding to one of the plurality of rows in the comparator circuit; and supplying the plurality of determination data from the comparator circuit to the writing control circuit, wherein the writing control circuit controls a selection of the plurality of gate lines row by row in each frame period, based on the plurality of determination data, wherein each of the plurality of determination data indicates whether the nth frame image data in one of the plurality of rows and the (n+1)th frame image data in a corresponding row are the same or different, wherein, when one of the plurality of determination data indicates that a first data which is the nth frame image data in the mth row and a second data which is the (n+1)th frame image data in the mth row are the same, the writing control circuit does not select the gate line in the mth row, wherein, when the one of the plurality of determination data indicates that the first data and the second data are different, the writing control circuit selects the gate line in the mth row, and wherein the second memory device supplies the (n+1)th frame image data in the mth row to the first memory device so that the nth frame image data in the mth row is overwritten with the (n+1)th frame image data in the mth row in the first memory device.

10. The driving method of a display device according to claim 9, wherein, when the gate line in the mth row is selected in two or more successive frame periods, video voltages having same polarity are input to the pixel portion in the two or more successive frame periods.

11. The driving method of a display device according to claim 9, wherein the display device further comprises a driver circuit electrically connected to the pixel portion, wherein, when one of the plurality of determination data indicates that the first data and the second data are the same, the writing control circuit controls the driver circuit so that the second data is not written to the pixel portion, and wherein, when the one of the plurality of determination data indicates that the first data and the second data are different, the writing control circuit controls the driver circuit so that the second data is written to the pixel portion.

12. The driving method of a display device according to claim 9, wherein a number of the plurality of rows is the same as a number of the plurality of determination data which are generated by comparing the nth frame image data and the (n+1)th frame image data.

13. The driving method of a display device according to claim 9, wherein the pixel portion comprises a plurality of pixels arranged in the plurality of rows, wherein each of the plurality of pixels comprises a transistor and a liquid crystal element, and wherein a channel formation region of the transistor comprises an oxide semiconductor.

14. The driving method of a display device according to claim 9, wherein the pixel portion comprises a plurality of pixels arranged in the plurality of rows, wherein each of the plurality of pixels comprises a transistor and a liquid crystal element, wherein a channel formation region of the transistor comprises an oxide semiconductor, and wherein an off-state current per micrometer of a channel width of the transistor is less than or equal to 10 zA.

15. A display device comprising:

a pixel portion including a plurality of gate lines arranged in a plurality of rows;

a first memory device which is a frame memory, the frame memory being capable of storing an nth frame image data (n is a natural number);

a second memory device which is a line memory, the line memory being capable of storing an (n+1)th frame image data in an mth row (m is a natural number);

a comparator circuit configured to compare the nth frame image data and the (n+1)th frame image data row by row, and generate a plurality of determination data each corresponding to one of the plurality of rows; and a writing control circuit configured to control a selection of the plurality of gate lines row by row in each frame period, based on the plurality of determination data supplied from the comparator circuit, wherein each of the plurality of determination data indicates whether the nth frame image data in one of the plurality of rows and the (n+1)th frame image data in a corresponding row are the same or different, wherein, when one of the plurality of determination data indicates that a first data which is the nth frame image data in the mth row and a second data which is the (n+1)th frame image data in the mth row are the same, the writing control circuit does not select the gate line in the mth row, wherein, when the one of the plurality of determination data indicates that the first data and the second data are different, the writing control circuit selects the gate line in the mth row, and wherein the second memory device supplies the (n+1)th frame image data in the mth row to the first memory device so that the nth frame image data in the mth row is overwritten with the (n+1)th frame image data in the mth row in the first memory device.

16. The display device according to claim 15, wherein the display device further comprises a driver circuit electrically connected to the pixel portion, wherein, when one of the plurality of determination data indicates that the first data and the second data are the same, the writing control circuit controls the driver circuit so that the second data is not written to the pixel portion, and wherein, when the one of the plurality of determination data indicates that the first data and the second data are different, the writing control circuit controls the driver circuit so that the second data is written to the pixel portion.

17. The display device according to claim 15, wherein, when the gate line in the mth row is selected in two or more successive frame periods, video voltages having same polarity are input to the pixel portion in the two or more successive frame periods.

18. The display device according to claim 15, wherein the pixel portion comprises a plurality of pixels arranged in the plurality of rows, wherein each of the plurality of pixels comprises a transistor and a liquid crystal element, and wherein a channel formation region of the transistor comprises an oxide semiconductor.

* * * * *